US006325012B1

(12) United States Patent
Aristizabal

(10) Patent No.: US 6,325,012 B1
(45) Date of Patent: Dec. 4, 2001

(54) BUBBLE TYPE SUBMARINE CABIN

(76) Inventor: Luis Alberto Aristizabal, P.O. Box 57713, Santa Fe de Bogota, D.C. (CO)

( * ) Notice: Subject to any disclaimer, the term of this patent is extended or adjusted under 35 U.S.C. 154(b) by 0 days.

(21) Appl. No.: 09/511,109

(22) Filed: Feb. 23, 2000

(30) Foreign Application Priority Data

Feb. 23, 1999 (CO) ..... 99011064

(51) Int. Cl.[7] ..... B63C 11/00
(52) U.S. Cl. ..... 114/314; 405/195.1
(58) Field of Search ..... 114/314, 312, 114/334; 405/188, 189, 195.1, 206, 207; 52/81.6, 82, 169.1, 244

(56) References Cited

U.S. PATENT DOCUMENTS

| | | | | |
|---|---|---|---|---|
| 3,295,265 | * | 1/1967 | Hida | 52/82 |
| 4,047,390 | * | 9/1977 | Boyce, II | 405/188 |
| 4,058,945 | * | 11/1977 | Knapp | 52/244 |
| 4,087,980 | * | 5/1978 | Kono | 405/188 |
| 4,186,532 | * | 2/1980 | Kahn | 52/169.1 |
| 4,195,628 | * | 4/1980 | Lubitzsch et al. | 128/201.27 |
| 4,274,405 | * | 6/1981 | Schmidt et al. | 128/205.26 |
| 4,299,066 | * | 11/1981 | Thompson | 52/81.6 |
| 4,565,149 | * | 1/1986 | Clasky et al. | 114/264 |
| 4,852,508 | * | 8/1989 | Takada | 114/177 |
| 4,904,118 | * | 2/1990 | Thiemann, III | 405/195.1 |
| 4,928,614 | * | 5/1990 | Forman | 114/66 |
| 5,438,958 | * | 8/1995 | Ericsson et al. | 119/223 |

OTHER PUBLICATIONS

Structures Sous Marines, pp. 32–33, Oct. 1979, Philippe Ducos & Denis Latour.
Le Monde de Lamer, "Aqualab" cover and pp. 32, 33 and 34 (date not indicated in article estimated publication date of 1995 0r 1996).

* cited by examiner

*Primary Examiner*—S. Joseph Morano
*Assistant Examiner*—Andrew Wright
(74) *Attorney, Agent, or Firm*—Smith, Gambrell & Russell, LLP

(57) ABSTRACT

A complete design for a submergible cabin is submitted, which provides commodities and standards required for housing 8 people with absolute commodity and safety under the water for an indefinite period of time. The infrastructure for life support is located at the coast and the supplies are driven through pipelines anchored to the sea bottom. The level of water in the lower access, which works under the upside down cup principle, is controlled by redundant level sensors, which in turn allow access of fresh air to the cabin, sending to the coast part of the used air in order to not recycle the same air and evacuate bad smell, $CO_2$ and heat from air conditioner and refrigerator units. The design of the shells and the structure allows its transportation in standard containers and then assembly at the dock, close to the installation place. The total construction from ceiling to floor is carried out with only 3 small forms due to the design is done with repeating pieces in order to reduce costs.

26 Claims, 33 Drawing Sheets

VIEW B - B'

VIEW E - E'

VIEW F - F'

VIEW H - H'

BUBBLE TYPE SUBMARINE CABIN

FIELD OF THE INVENTION

The invention hereinbelow described is in general, related to the construction of a new type of submarine cabin that provides an ideal environment to satisfy entertaining, medical, and/or sport activities. According with the design of the cabin, this is built to remain anchored to the sea floor, in such a way as to bring all the time a useful or pleasing environment and at the same time, to fulfil the essential needs.

BACKGROUND OF THE INVENTION

Right now, all around the world, aquariums are containers of different sizes and shapes, using glass or acrylic walls to store water and inside, some animal and vegetable living species, such as fishes and seized coral, without freedom and out of their natural environment, just to offer a visual entertainment.

About to provide submarine housing we can mention the first experiment realized by Jaques-Ives-Cousteau in 1962 called "Precontinent I". In this experiment, two persons Albert Falco and Claude Wesly remained seven days at 10 meters depth, in a spherical module, going out three times per day to perform their tasks.

In 1963, in the Red Sea another experiment was conducted, the Precontinental II", in which two divers remained for a week at 28 meters depth and eight more divers remained for one month at 11 meters depth.

In 1965, Precontinental III was conduced and six divers remained three weeks at 100 meters depth in a capsule alike to a train wagon. In this experiment, the occupants would breath a mixture of oxygen and helium to counteract the effects of the blood nitrogen assimilation, due to the high deep and long time exposure. This experiment was realized in order to perform tasks on an oil structure at 120 meters depth.

By the same time, the American navy realized the experiment SEALAB II close to the California coast, in which a large steel cylinder lodged 10 men and at 61 meters depth lived for 15 days. In 1969 the Americans launch the program TEKTITE in the Virgin Islands on the Antilles Sea, in which four men remained 60 days at 15 meters depth with the aim to prove that if permanent living at the bottom of the sea, allows man to realize permanent tasks at that deep. In 1970 it was repeated the experience TEKTITE II, and for the first time, a team of five women was involved. After 10 years, Jacques Rougerie, a French architect and his multidisciplinary team develops a project called Architecture of the sea, and as a result the experiments CALATHEÉ, AQUABULLE, HIPPOCAMP and AQUALAB are brought about, which allowed to work for as long as a month without coming back to surface, solving the decompression problems by raising the capsule with cables and polleys in order to lower the pressure.

DESCRIPTION OF THE DRAWINGS

The FIG. 1 shows a general plane of the bubble. This figure contains a lateral view of the bubble along with its external parts. The dimensions of this bubble approximately are: bubble total external diameter: 9.5 m; total height including its legs: 5.6 m; cabin height without the legs: 4.12 m; dwelling place internal height: 2,20 m; approximate depth of sea floor required for installation: 9.2 m to 12.2 m; height from the anchorage block to the cabin: 1.44 m; exterior distance between legs at the bottom part: 5.66 m; available area: 71 $m^2$; total volume: 203 $m^3$. Each one of the following numerals indicate in the FIG. 1:

(2) Steel legs anchorage to the anchorage block, protected with a 6 mm layer of high-density polyurethane.

(4) Upper and lower skulls made of fiberglass reinforced with polyester, in the shape of "trunk of a cone" which form the external floor and roof of the bubble, which cover the metal structure and keep the airtightness of the cabin.

(6) Lateral glass system from floor to roof all around of the 360 degrees for outside total view, built up from 12 acrylic (Plexiglas) shells which form a vertical axis cylinder.

(66) Upper-glass system made up of acrylic for viewing towards the surface.

(8) Lifting handles, which is mirror image of the lower legs in order to keep the total resemblance of the upper and lower skulls of the bubble and their symmetry.

(10) Sketch of the anchorage block where the bubble will be attached to avoid its flotation.

Figure 1:
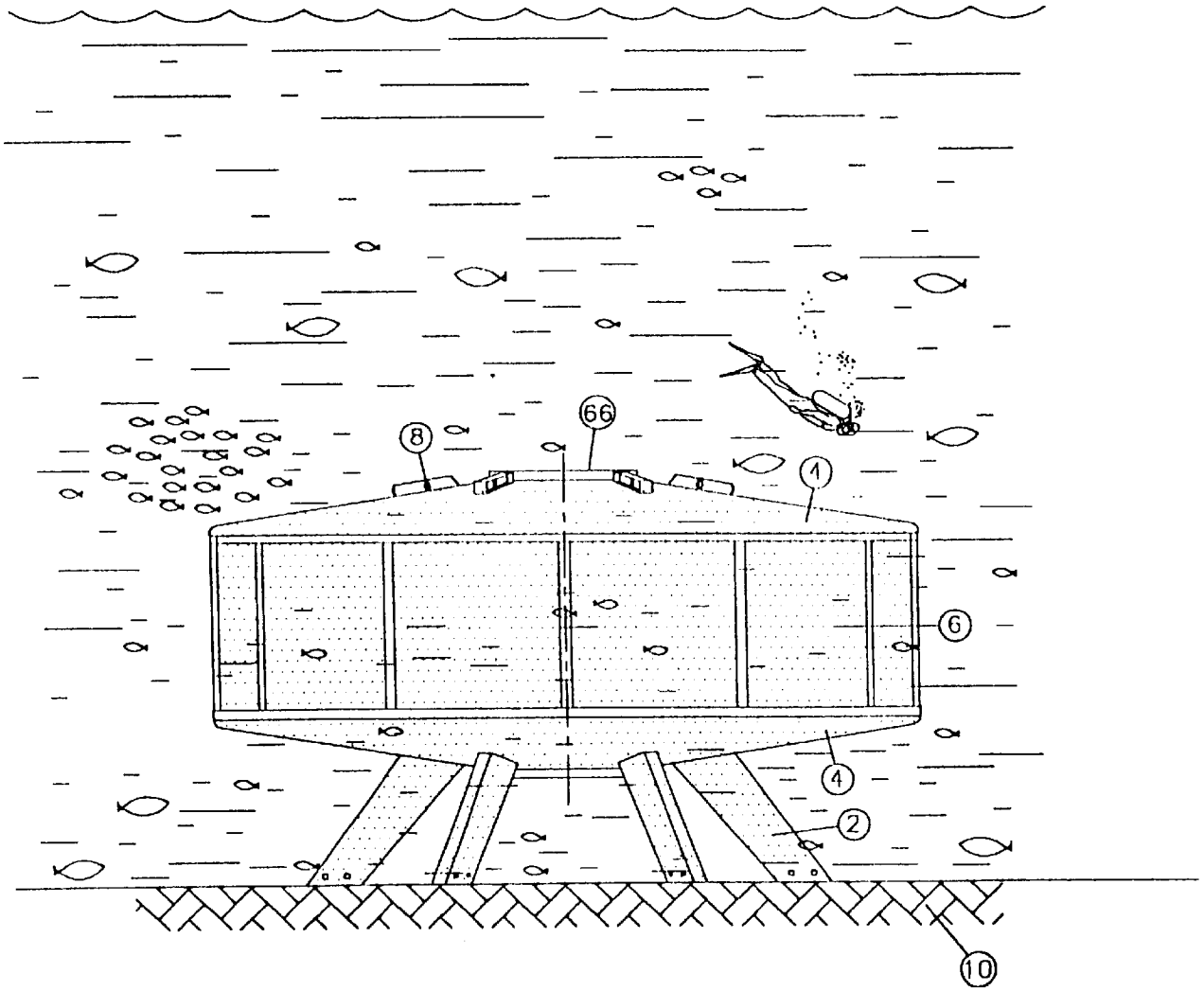
Figure 2:
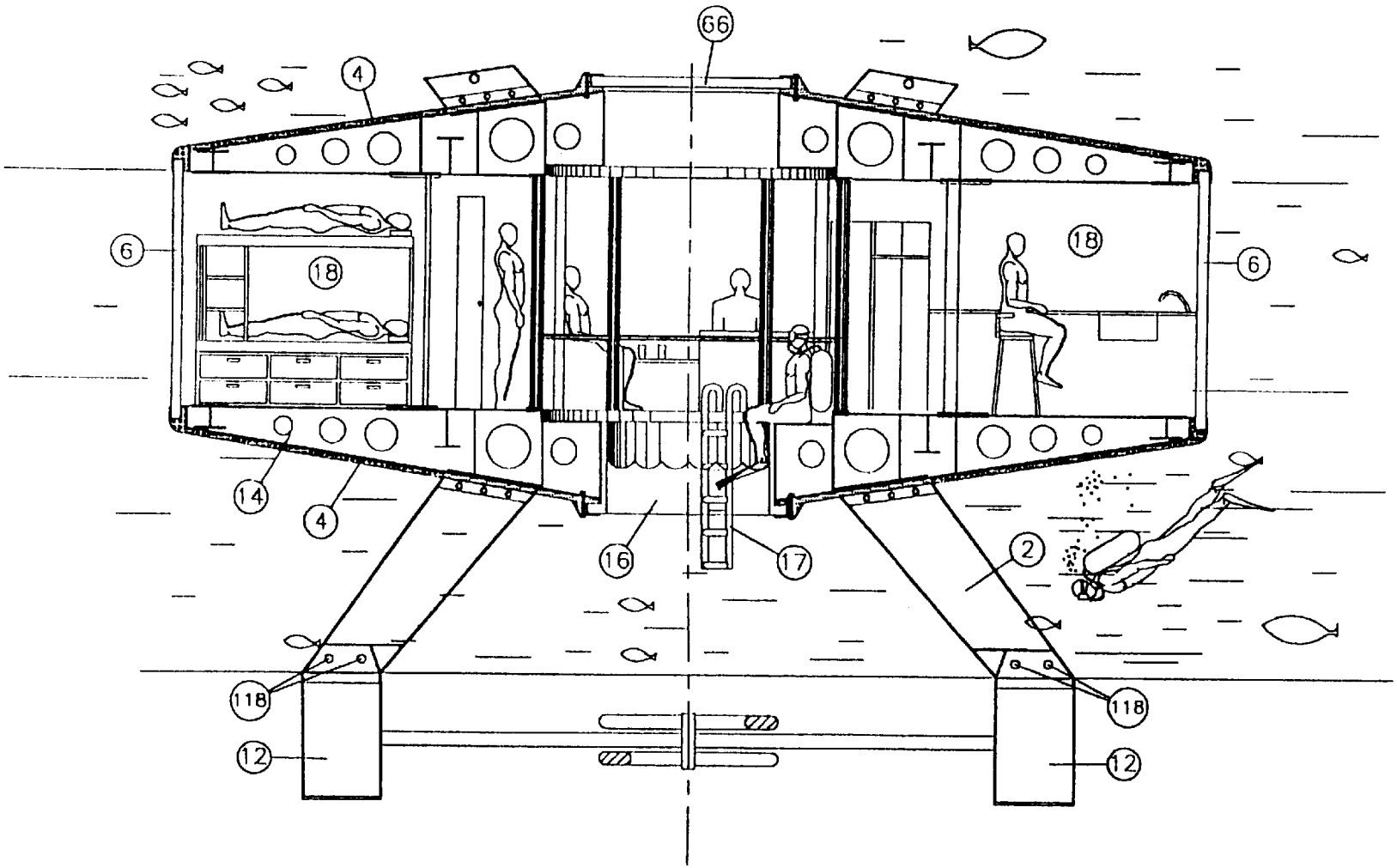

FIG. 2 is a cross sectional view which illustrates a total central vertical cut of the bubble, which sketches the same points of the FIG. 1, adding the structural part and the part of the legs which are embedded into the anchorage block, and which will serve as cradle for the bubble legs. It also shows the useable part of the dwelling space, and the fake roof occupied by the structures. In FIG. 2, the following numerals will indicate:

(12) Cradle for the bubble legs, embedded into the anchorage block.

(14) Structure ribs, made of steel protected by naval paint Hempel type, with circular holes for passing pipelines, conduit and cables.

(16) Entry cylinder or entry mouth with approximately 1.5 m diameter, which works by using the inverted cup principle.

(17) Auxiliary removable little ladder.

(18) Bubble dwelling place with kitchen, living room, bathrooms, etc.

(118) Bubble anchorage pins for anchoring the bubble to the anchorage block (twelve units, two for each leg, with a diameter of 5.08 cm.)

Figure 3:
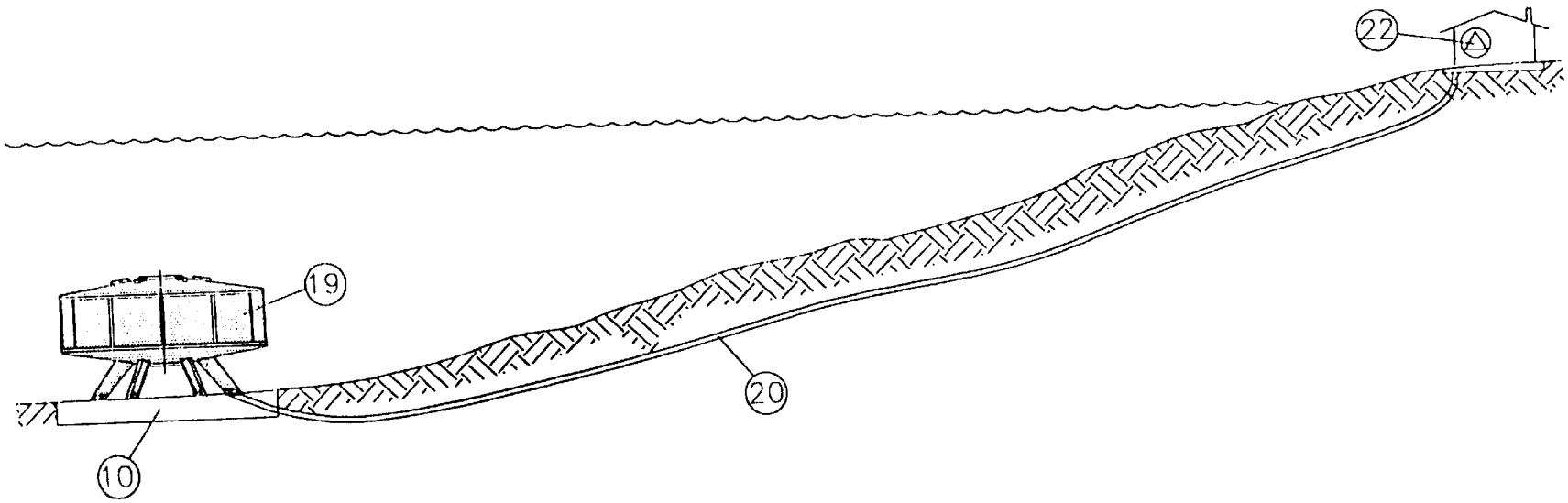

FIG. 3 illustrates a location general plane. The bubble must be installed close to the coast, between 50 m to 1 km afar, and from 9.144 m to 12.192 m depth. There are many pipelines from the coast to the bubble inside of a large pipeline (20) anchored to the sea floor, in order to provide supply and return of air and water, electric current, control signals, and communications signals. These pipelines start from an infrastructure house or from two containers (22) at the coast which will contain needed equipment for life support: air compressors, filters, dryers, tanks, hydropneumatic pumps, power plants, UPS (Uninterrupted Power Service), control computer, etc. In FIG. 3, each one of the following numerals indicates:

(19) Bubble anchored to the sea bottom.

(10) Anchorage block built in concrete and steel with 12-m diameter and 1.2 m height; it contains in the interior space the cradles for the bubble legs, reinforcing steel rods, high-density scrap metal to increase its weight. This anchorage block cast in place could be replaced by a natural anchorage mass of equivalent weight or higher (269 ton), if it fulfills the required characteristics concerning weight, resistance, homogeneity, etc. In that case, the cradles will be anchored with epoxy nailing blocks in each leg.

(20) Pipelines anchored to the sea bottom (supply and return air pipelines, supply and return water pipelines, electric power, systems of signals, control and communications).

(22) Cabin or soundproof containers for equipment: air compressors, filters dryers, tanks, hydropneumatic pump, power plant, UPS (Uninterrupted Power Service), control computers, etc.

Figure 4:
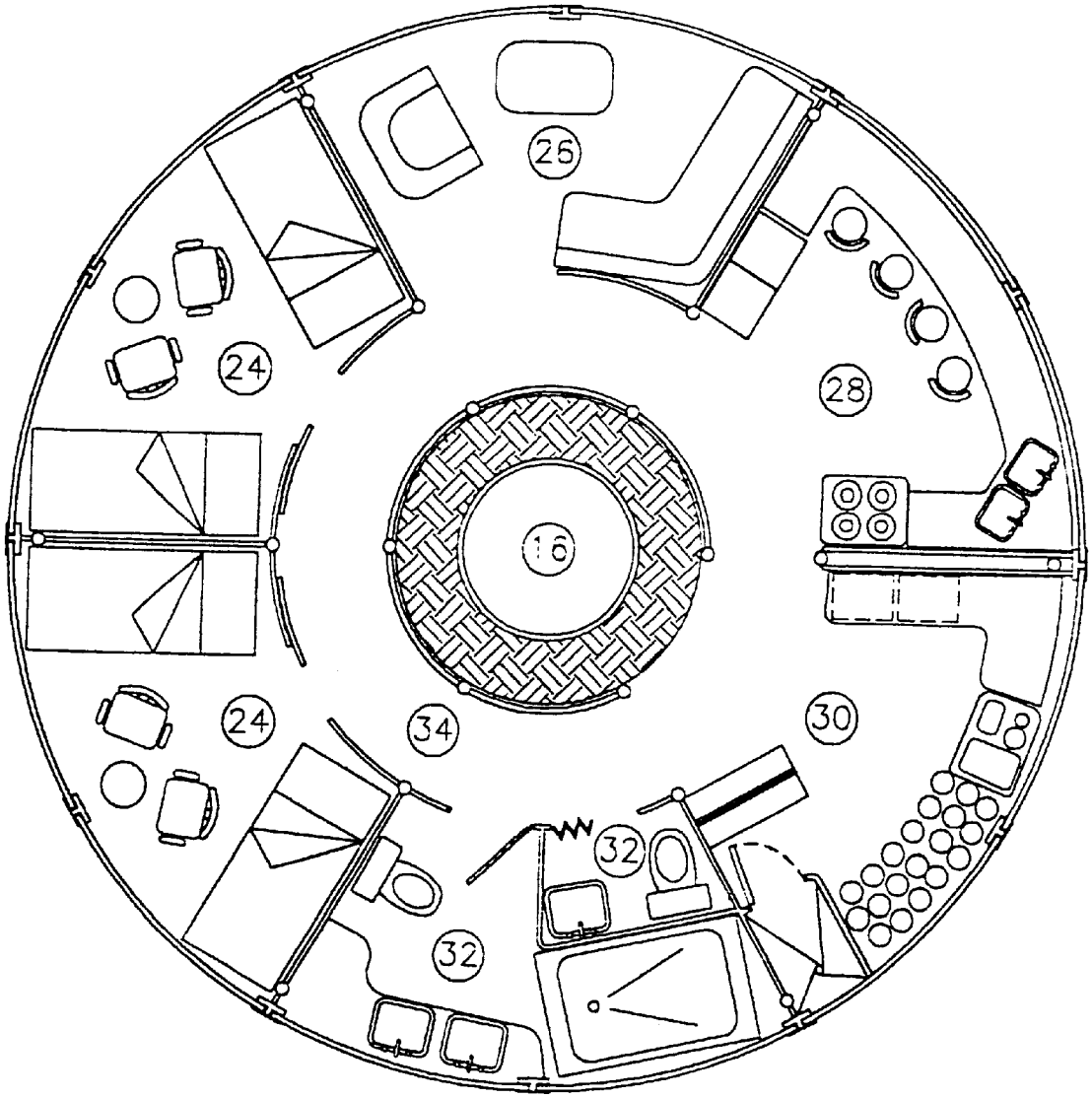

FIG. 4 illustrate alternative I, for architectonic distribution. In this figure, an alternative distribution is sketched for giving lodging to eight people. The available 71 $m^2$ are divided in six different environments, using floor to roof divisions or walls, an entrance and circulation hallway, and entrance mouth at the center, all of which is unchanged in all the different alternatives. In the FIG. 4, each one of the following numerals indicate:

(24) Bedrooms with two staterooms, with capacity for four people each one.

(26) Living room with sofas and table.

(28) Kitchen with the usual endowment: electric stove, microwave oven, two small refrigerators, two dishwashers, and a bar of the dinning room type.

(30) Control station that includes a table for the control computer, conditioned air equipment, compressor for filling tanks, shower and chair for equipment installment.

(32) Auxiliary bathroom with toilet, lavatory, and a main bathroom with toilet, two lavatories, shower bath, bathtub with jacuzzi.

(34) Circulation hallway to all the environments.

Figure 5:
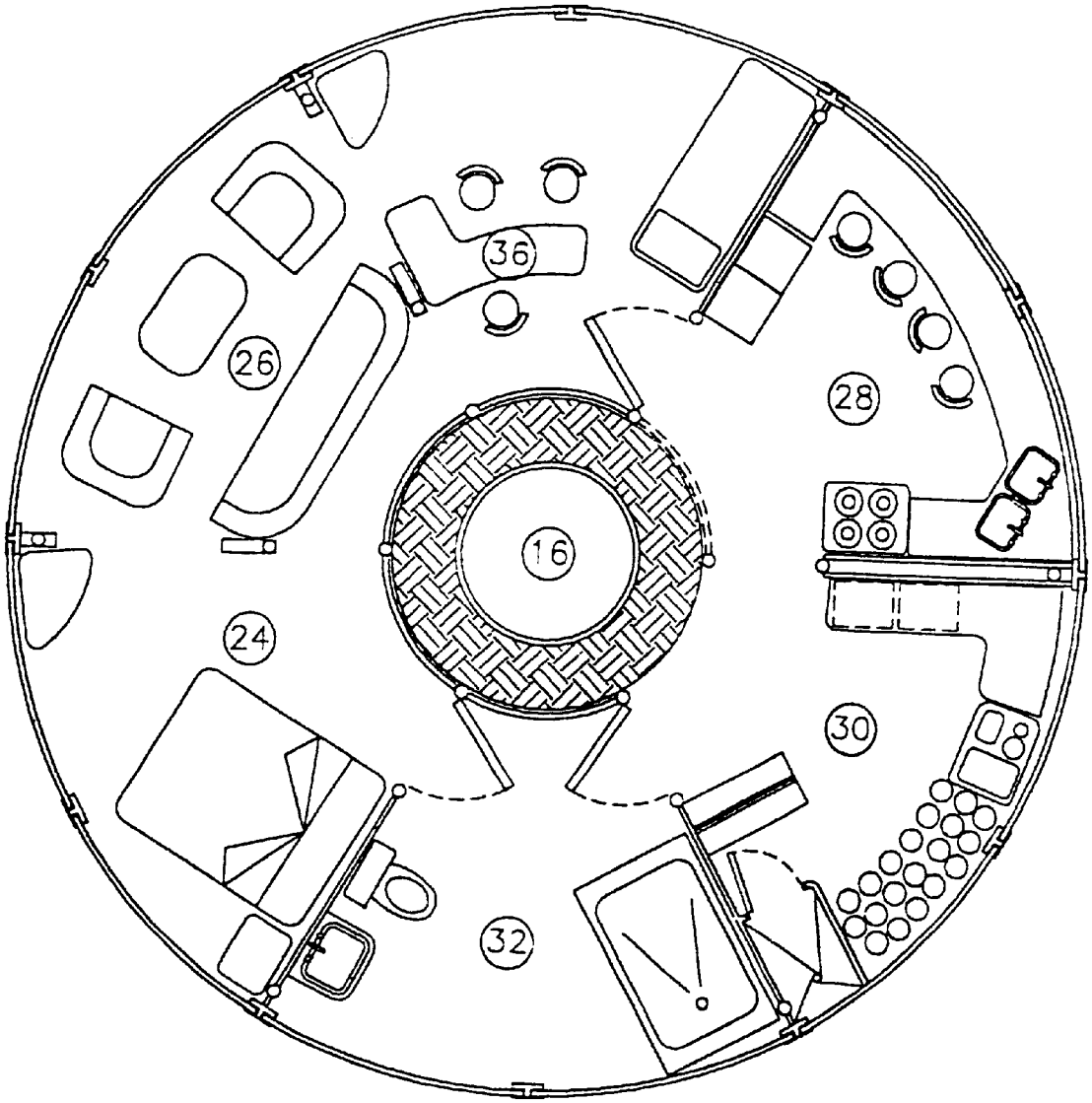

FIG. 5 illustrates the alternative architectonic distribution II. In this figure it is shown another of the many distribution alternatives, a suite like option, in which bedrooms and living room form a large environment, with queen size bed and auxiliary sofa, living room, bar, with capacity for two or three people. The remaining environments are the same as in the alternative shown in FIG. 4 (kitchen, control station), except for one of the bathrooms, which is larger.

Figure 6:
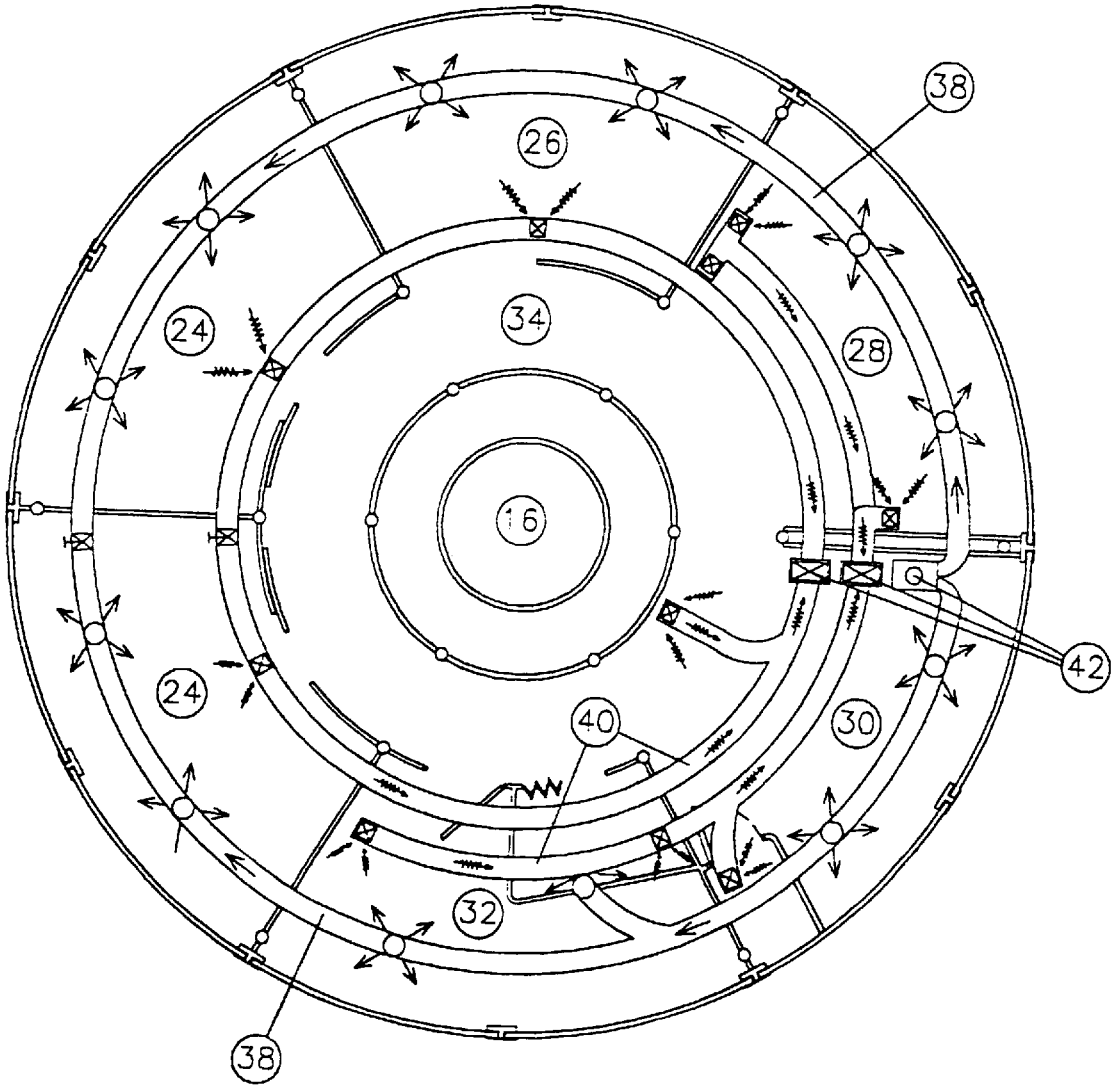

FIG. 6 illustrates supply and extraction air conditioned distribution networks. Inside of the false ceiling of the dwelling, there are distributed three conduit networks; one for supplying conditioned air to the perimetrical part and the other two for suction or return toward the central part (one for general suction and the other for suctioning the most contaminated air from bathrooms, kitchen and refrigerators). The conduits are provided with grids adjustable, as to volume of and direction of the exit flow, and also with dampers inside the conduits for zone separation. In FIG. 6, each one of the following numerals indicate:

(38) Supply conduit and grids.

(40) Extraction or return conduit and girds.

Figure 7C:
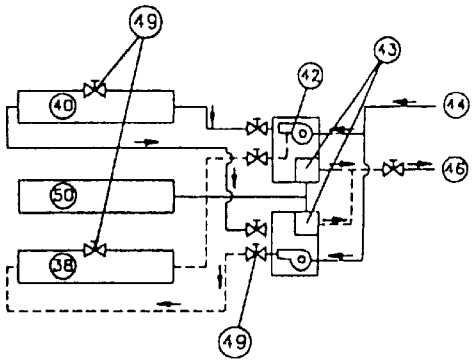
Figure 7A:
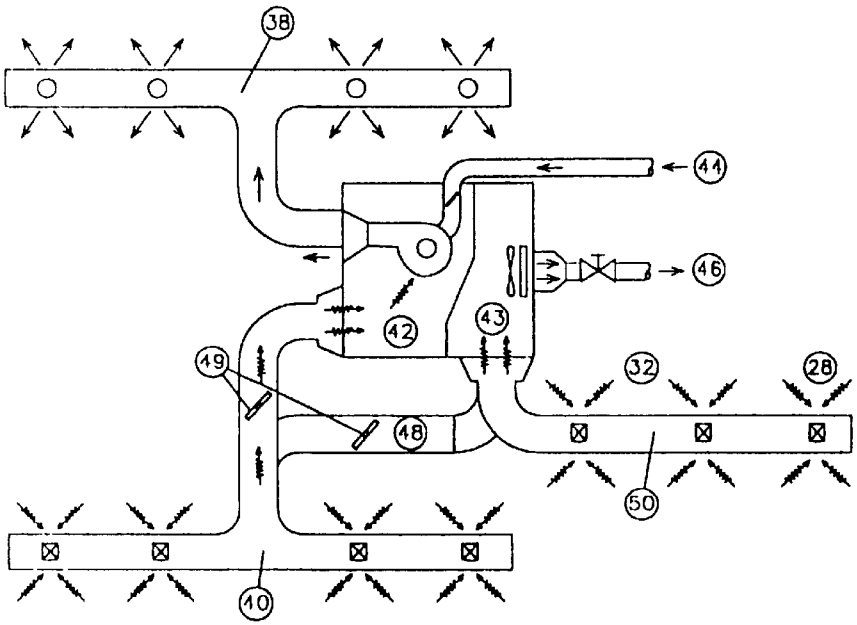
Figure 7B:
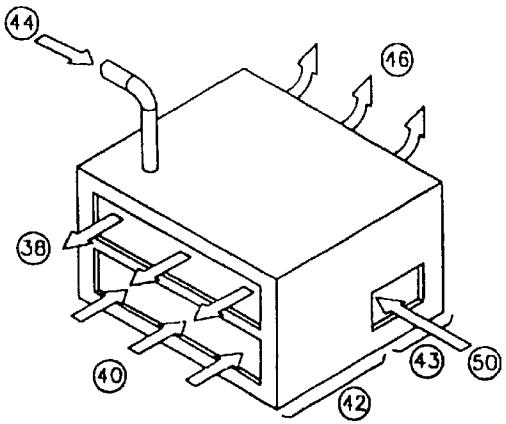

FIG. 7 is an air-conditioned sketch. It is schematically shown in this figure the separation of the flows from the manager unit and from the condenser unit as well as another unifilar diagram of the system by using two air-conditioned units, which can be used together or individually according to occupancy status.

As it is seen in the first sketch, returned air (40) is mixed in the manager unit (42) with fresh air (44) coming from the external compressors, in order to be then ejected by a centrifugal fan towards the supply conduits (38), which distribute the conditioned air (in temperature and humidity) to all cabin environments. Manager units have not only evaporators for adjusting temperature by means of thermostat, but humidifiers also, to adjust relative humidity by humidostats, to achieve a confortable environment, that is, a temperature of about 22–23° C. and 50% relative humidity. Heat generated by the condensation units of the equipments, will be driven out by the wasted or renewal air, going towards the venting tube, that is, it will return to main land taking away smell and temperature from bathrooms, kitchen and refrigerators and air conditioned condensation units, recirculating air free from $CO_2$ using "soda" (like submarines).

In the second sketch it is shown, in unifilar manner, the possibility the system has for using the two units in the system either simultaneously or individually, operating the dampers and depending on the temperature requirements and availability of the two equipments, since one of them could be on maintenance and the other on duty.

A third sketch is showing the flow direction on a package unit. The air going out through the air-discharge tube is pushed out by means of the condensation unit fan by using the pressure difference between the bubble (202.650 kPa) and outside pressure (101.325 kPa) and using this parameter and the required flow, the return tube (air-discharge to main land) diameter has been calculated by using Muller's formula. In FIG. 7 each one of the following numerals indicate:

(42) Air-conditioned manager unit.

(43) Air-conditioned condensation unit.

(44) Air coming from main land compressors.

(46) Air-discharge tube.

(48) By-pass or auxiliary connection tube (49) Damper (regulator) or air flow valve.

(50) Air suctioned from bathrooms and kitchen.

Figure 8:
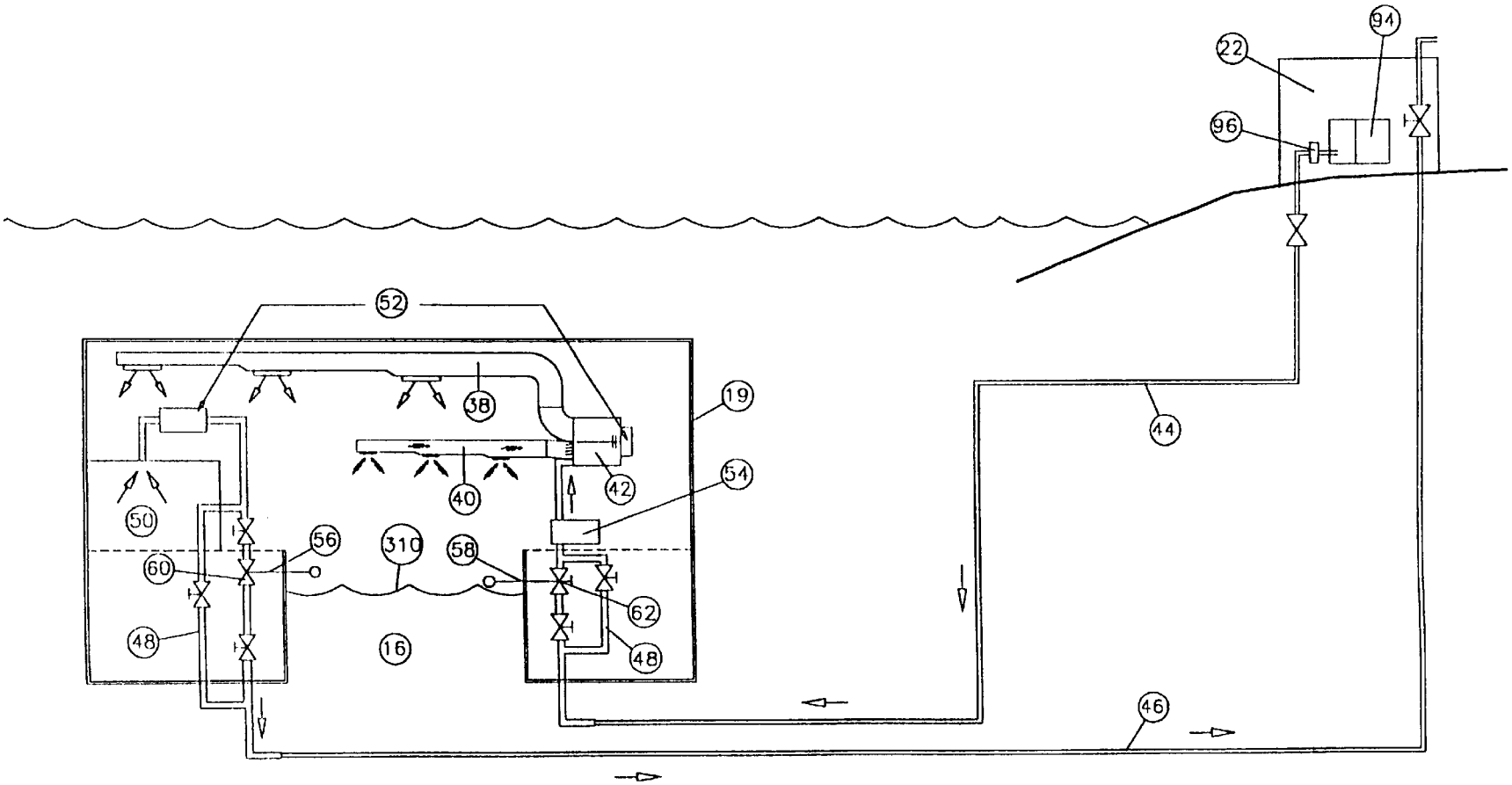

FIG. 8 illustrates a pneumatic scheme (breathable air). In a schematic way it is shown the compressed air flows from infrastructure containers (22) to the submerged bubble (19) through the supply tube network (44) by pressure, of about 413.685 kPa, and the return trip from the bubble (19) to main land through the air discharge piping (46) with a expelling pressure of 202,65 kPa from the bubble and reaching outside at 101,35 kPa. It is shown also the air entry control assumed by the capacitive level sensor (58) which moves the motorized valve (62) to allow compressed air to enter into the absorption muffler and expansion chamber (54) and then to be mixed and distributed by the air-conditioned system towards all environments (38). The capacitive level sensor (58) registers the level of the thin sheet of water at the bubble entrance mouth, more exactly, at the level sensors chamber (152) and deals with the height of this thin sheet allowing air entrance into the cabin through the motorized register (62). The water thin sheet (310) at the entry mouth tends to go up due to the air loss through the air-discharge piping, since air flows spontaneously from where pressure is higher (202,65 kPa inside the bubble), to where pressure is lower (101,325 kPa outside). This continuous venting from the bubble, breaks up the "inverted cup" principle allowing water to ingress through the bubble entry mouth, but this water ingress is compensated with air ingress, allowed by the respective valve (62) and controlled by the same level of the water thin sheet by the capacitive level sensor (58), thus keeping a little fluctuation in air height, allowing air replacement in the suitable proportion to keep cabin air clean and breathable for nine occupants. To prevent an exaggerate amount of water to go through the entry mouth inside the bubble, and to make the pneumatic system redundant, the venting tube (46) is provided with a motorized valve (60) which is controlled by a vibration type level sensor (on-off) (56) calibrated to detect if the water level is over the allowed height by the capacitive sensor (58), acting immediately on the air exit valve (60), closing it, thereby attaining to stop the going up of the thin sheet water, that is, the water entry inside the bubble; at the same time an alarm is triggered and a sign of "exaggerated thin sheet of water level" to warn the control personal about a possible failure at the compress air supply. Both systems, the one of supply of air (62) and the one of air return (60), are provided with an auxiliary pipe network with control valves (48) to provide a by pass, allowing to take away the valves to maintenance, performing them a temporary handy operation by using the valves in the by-pass tubes. Since trapped air inside of the cabin acts on the water thin sheet as a spring, and in addition strong motion of the waves at surface, the water thin sheet will have also some oscillating level changes due to momentary pressure changes (water column) the entry mouth of the bubble has been provided with three "water thin sheet shock absorbers" (150), that is three cavities or water receptacles communicated to the mouth or entry cylinder by several holes or perforate plates (312) which will keep some amount of water when the water thin sheet goes up and put it back at the entry tunnel when the water thin sheet goes down. The foregoing is due to the fact that the reaction capacity of the compressed air supply is not as fast as to compensate the water thin sheet height oscillation and rather, it would tend to increase it.

In order to avoid that those oscillations could affect and confuse the level sensors, chamber or sensors (152) also have been provided with an interchangeable perforated plate in order to communicate the same with the mouth or entry cylinder (16) and thus dramatically drop quickly water thin sheet level fluctuations, by using holes in the perforated plate as shock absorbers for the system. In FIG. 8, each one of the following numerals illustrate:

(52) Air-conditioned equipment's condensation unit, whose coil is in the flow of the venting pipe.

(54) Expansion chamber and absorption muffle in the same element.

(56) Level sensor by vibration made of stainless steel.

(58) Level sensor of the capacitive type, with bulb, made of stainless steel.

(60) Air evacuation motorized valve, usually open and made of stainless steel.

(62) Compressed air entry motorized valve, usually closed, made of stainless steel.

Figure 9:
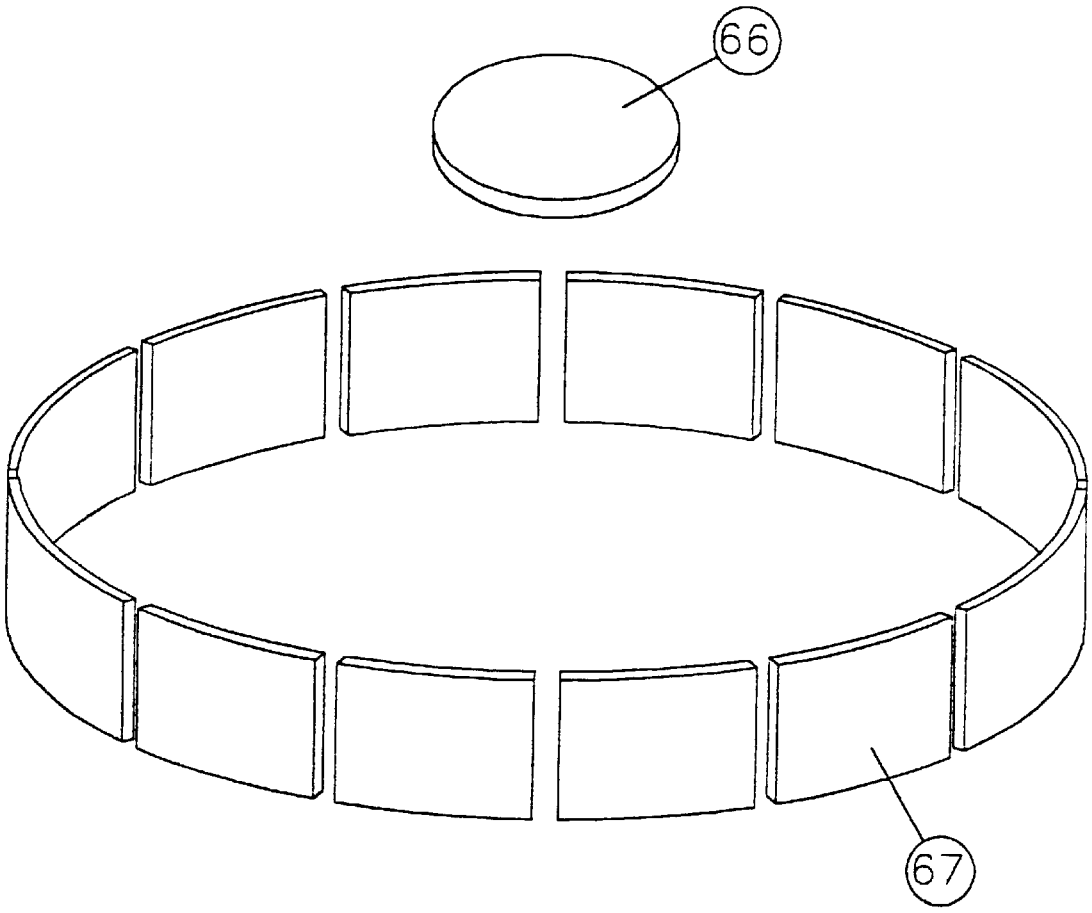

FIG. 9 illustrates a broken-away view of a crystal-sheet locking system made with acrylic for forming the bubble walls. In this figure are shown the elements, or windows made of acrylic or Plexiglas in their actual position. Those elements build up the transparent part of the bubble allowing external view from the interior. In FIG. 9 each one of the following numerals indicate:

(66) An acrylic disk of about 1,8-m diameter for the upper window.

(67) 12 acrylic arcs of about 2,4×2,4 m to build up the transparent cylinder.

Figures 10A, 10B, 10C, 10D:
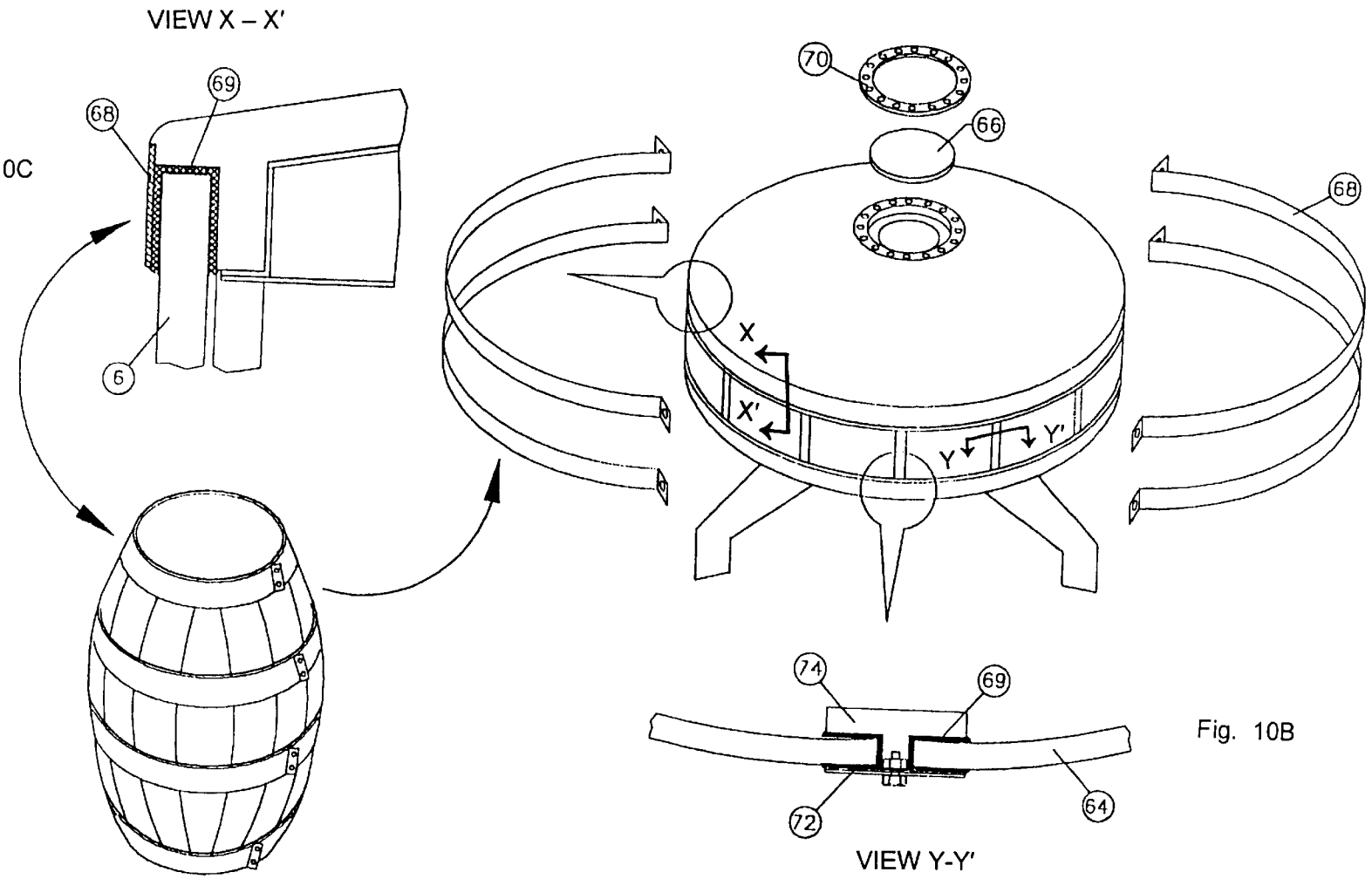

FIG. 10 illustrates windows, comer packings and glass holders. It is described there how to anchor and keep in place both upper and lateral acrylics. Upper and lower perimetrical metal elements (68) keep lateral acrylics acting as glass holders like a metal band in a barrel, with tensor mechanism, and windows expulsion force is distributed and compensated with the same amount of force exerted by the opposite window. In addition, it is shown some detail of the window vertical anchoring by glass holders (72) screwed to the vertical frame (74). Upper window (66) is kept in place by means of a metal ring (70) which is provided with holes for the passing screws which will exert the needed pressure to keep the seal through the packings. In FIG. 10 each one of the following numerals indicate:

(68) Glass holders of stainless metal band, like a barrel metal band.

(69) Gasketing of airtight seal

(70) Stainless metal glass holder, to keep in place upper acrylic.

(72) Stainless metal vertical glass holder.

(74) Vertical structure to warrant distance between upper and lower fiberglass hulls and which works also as frame to keep vertical joint among acrylics.

Figure 11A:
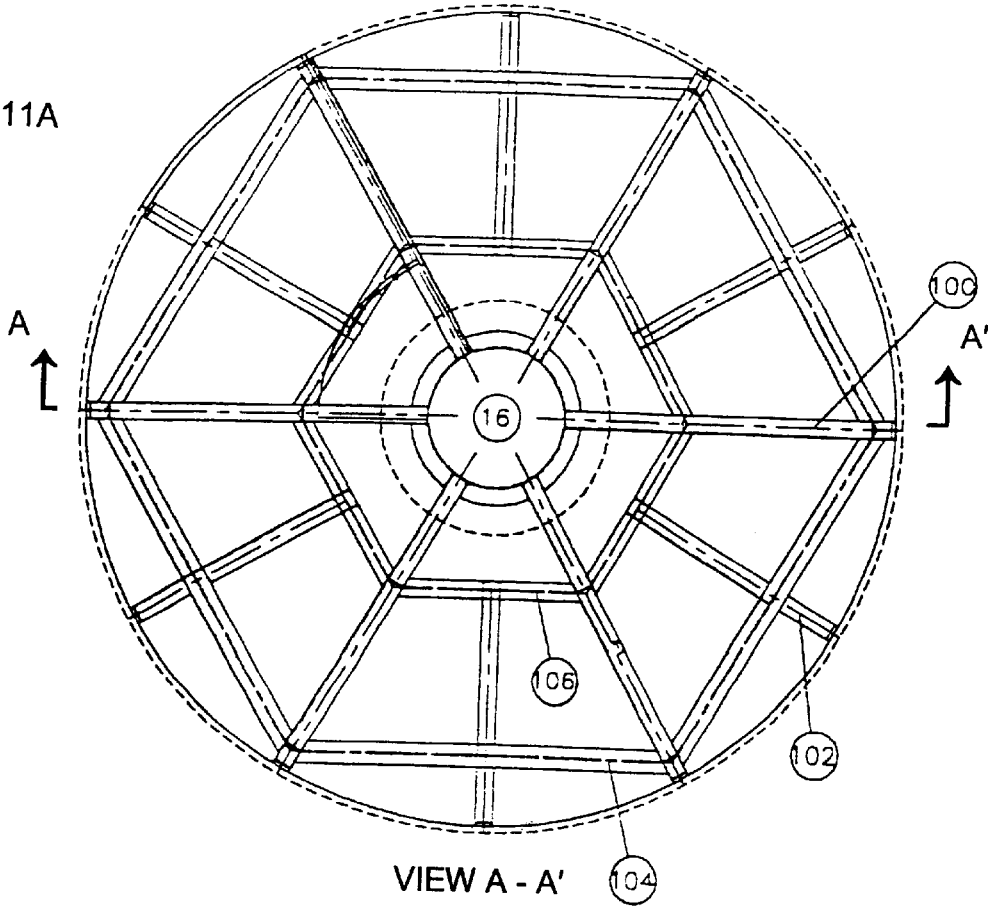
Figure 11B:
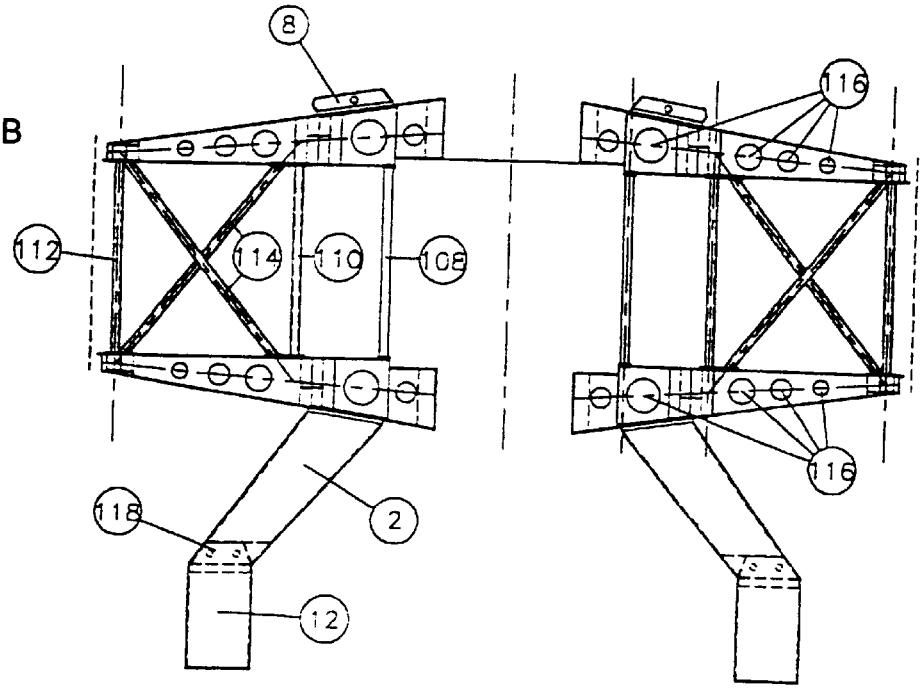

FIG. 11 illustrates a structural plane. As it is seen from the figure, the structure consists of two sections, with an upper and a lower section, which are identical each other except for the legs (2) in the lower section which are replaced by lifting handles (8) in the upper section. Each section consists of ribs (100 and 102), radially arranged in "C" channel, with transversal reinforcement members (104 and 106) in "I" beam, forming a hexagon. The six main radial ribs are joined together to an internal cylinder and the six secondary ribs are joined to the internal transversal members. In FIG. 11 each one of the following numerals indicates:

(100) Main structural ribs, in "C" channel (6 up and 6 down).

(102 Secondary structural ribs, in "C" channel(6 up and 6 down).

(104) Transversal external structural beams, in "I" bean (6 up and 6 down).

(106) Transversal internal structural beams in "I" beam (6 up and 6 down).

(108) Internal columns made of squared tube (6 units).

(110) Middle columns made of squared tube (6 units).

(112) External columns made of squared tube (6 units).

(114) Structural crosspiece made of squared tube, disguised in the walls (6 units)

(116) Circular holes on the ribs for passing pipelines.

(118) Anchorage pins (12 units total, 2 by each leg).

Figure 12:
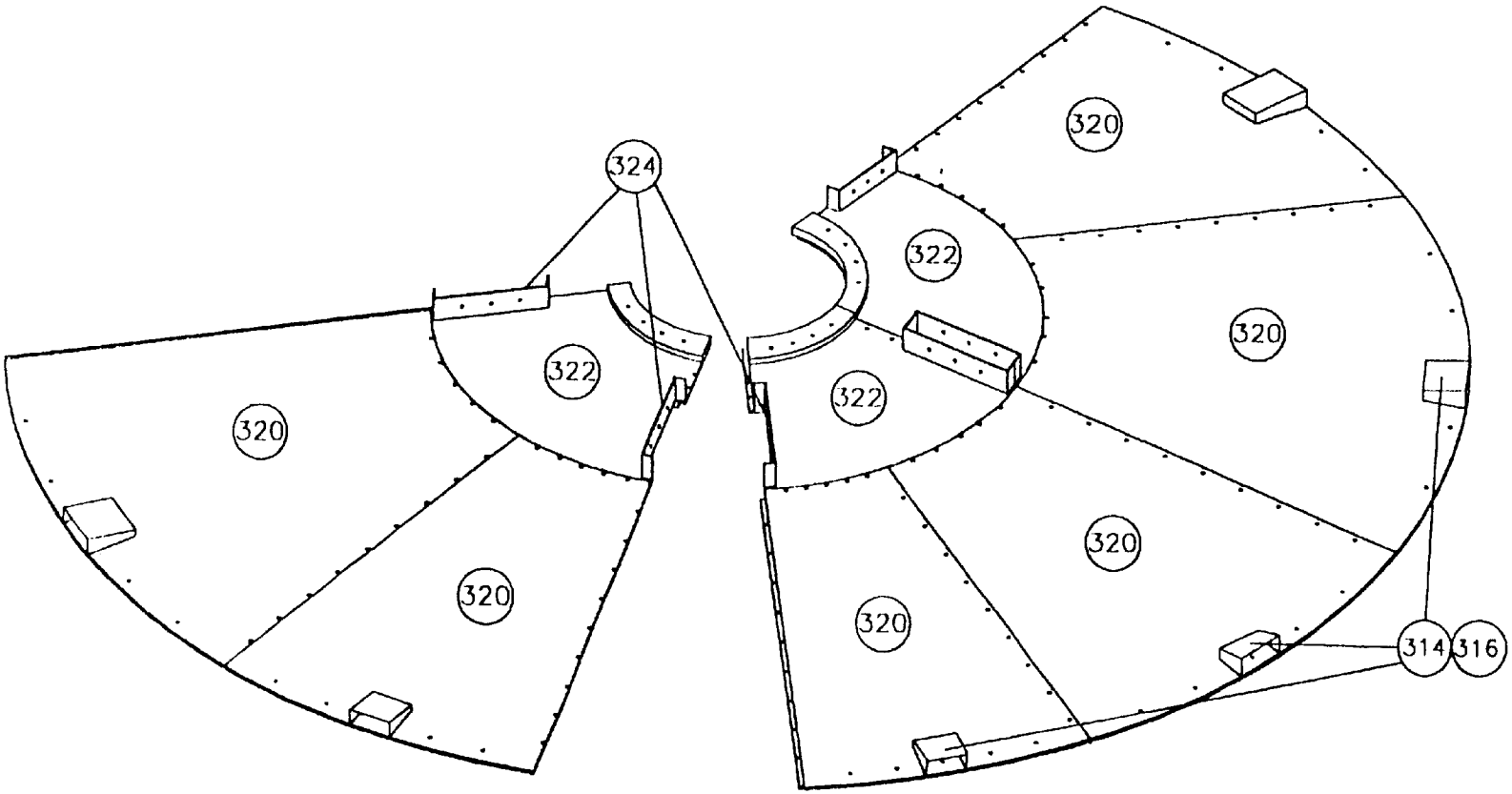

FIG. 12 illustrates fiber-glass hulls or upper coverings. This figure shows part of the assembly between the external (320) and internal (322) fiberglass hulls, locking members for legs and lifting handles (324), allowing to form airtight fit seals of the fiberglass hulls against the structural parts. Those hulls are manufactured on molds with fiber-glass strengthened with polyester (in a similar way as boat shells are done) including fixing screw holes between them, and anchorage to the structure, transparent parts for reflectors and the needed reinforcements for attaining rigidity and exactness. Only two molds are needed to build these hulls: one for the external hulls (320) and another for the internal hulls (322) since the upper and lower hulls are identical. In order to complete the upper and lower cones, 24 external hulls (320) and 12 internal hulls (322) are required. The dimensions of both types of hulls allow storing them on standard metallic containers for easy transportation. In FIG. 12 each one of the following numerals indicate:

(320) Fiber-glass external hulls, 24 units in total (12 up and 12 down)

(322) Fiber-glass inner hulls, 12 units in total (6 up and 6 down)

(324) Locking member of inner hulls for legs or lifting handles.

Figure 13:
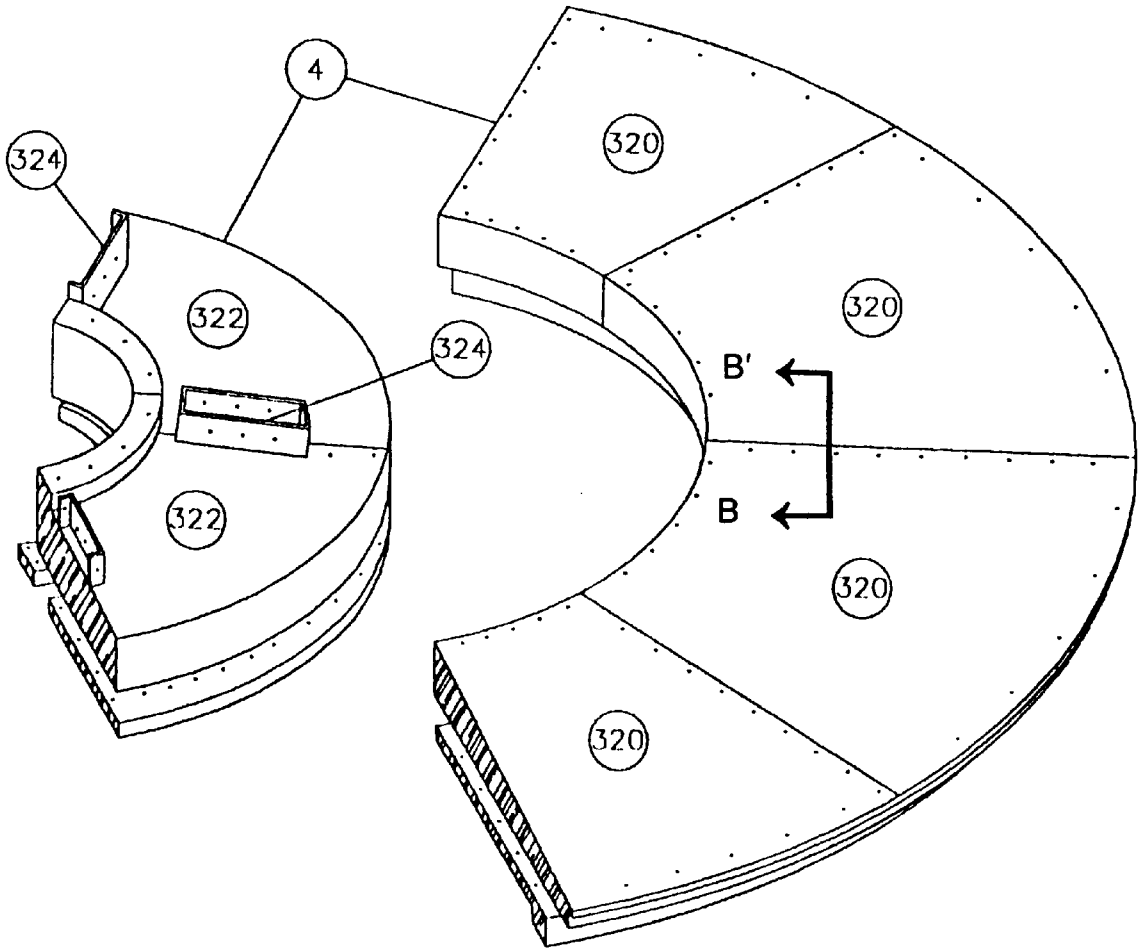

FIG. 13 shows a sketch of hull assembling. It illustrates the overlapping way in which external hulls are assembled and joined among them, and in the same way for the internal hulls. These shoulders or overlappings allow to install unions for airtight look between hulls and the structure, satisfying both functions at the same time.

Figure 14:
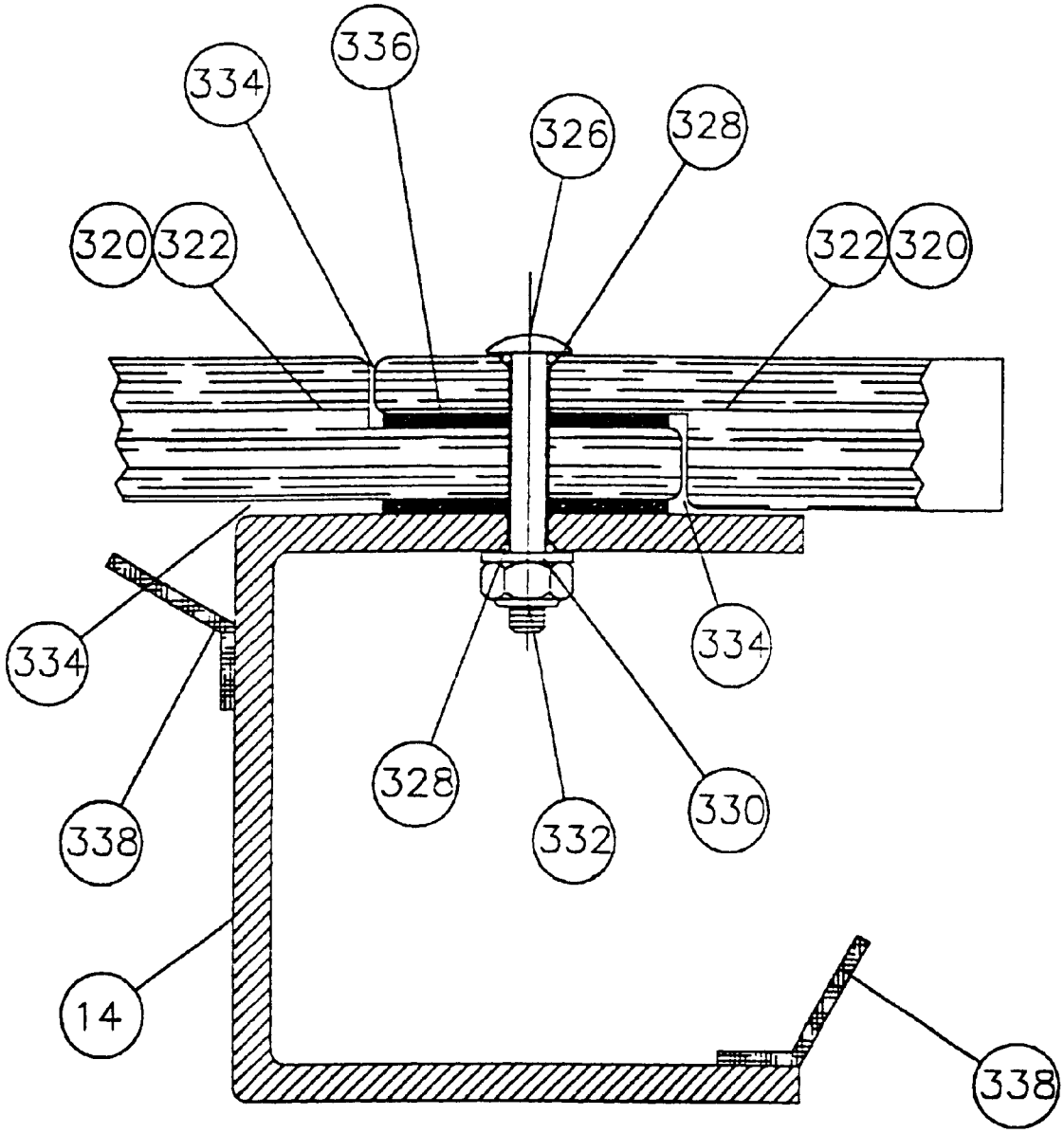

FIG. 14 illustrates how to fit the hulls to the structure. It is shown in section a typical union between two external hulls (320) or two internal hulls (322) or between an inner and an external hull through stainless steel screw (326) with smooth head for Bristol key, nut with safety liner and washer. Those screws carry out two functions: to join together the hulls, providing enough pressure to keep airtight the union with the packing, which in turn to act as a bridge for anchorage of said hulls to the structure (14). Two "O" rings (328) must be installed, one on the hull's external part, and the other one inside the steel structure, both in conic cradles, in order to cooperate to keep airtight the screw hole. In addition, in all cavities, both the screw and the union between hulls, it must also be applied silicone of the DOW CORNING 791 or 795 type or similar to keep airtight unions. As it is shown in this figure, the "C" channel (14) is provided with two gutters or flaps made of PVC (338) on suitable places in the channel, to drive any water filtration that could have happened in a long term, acting as roof canals, and driving water filtrations to the perimeter part (close to the wall paneling), and also through other canals on the window frames which will drive water to the fake floor, letting them to roll down to the bubble central part where they will be collected and drained out by a draining pump, or by the bubble general drainage (158). In FIG. 14 each one of the following numerals indicate:

(326) Stainless steel screw having smooth head with hole for Bristol key.
(328) "O" ring.
(330) Stainless steel washer.
(332) Safety nut with liner.
(334) Dow Corning 791 or 795 type silicone, or similar.
(336) Neoprene type packing.
(338) PVC canal.

Figure 15:
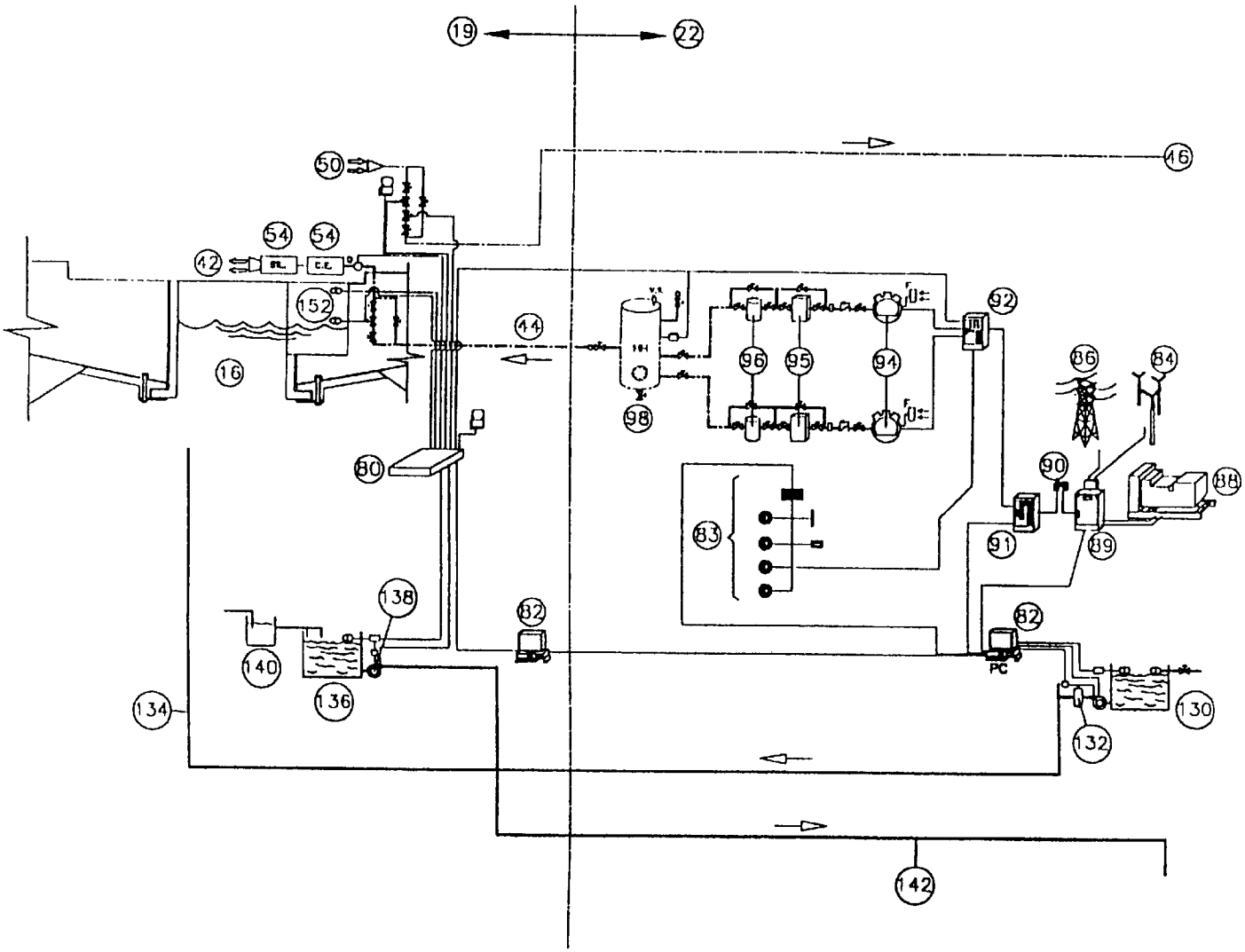

FIG. 15 illustrates an equipment and control scheme. It is an unifilar sketch in which a great part of the air, water, electric power and control networks between the infrastructure containers (22) (right hand side of the view) and the bubble (19) (left hand side of the view) are described. In the upper part it is shown the venting or air expulsion (46) coming from the bathrooms and kitchen extraction conduits (50).

Electric power (220volts, 3 phases, and 110 volts, 1 phase) is taken from the city electric network (86) (or from the closer available place); this could be replaced or aided by electric power that is obtained from eolic generator plants (84) (which generates electric power by using air) and if it needed, by a sound-proof electric generator diesel plant (88) of about 75 KW. Such electric plant possesses an automatic transference board (82) with tension monitors, plant breakers, and exclusion networks, faulty operation alarms with card of communication to the PLC, etc. Electric power that is provided from any one of these sources is controlled by this board, driven to an electric distribution board (91), which is partially powered by an UPS (Uninterrupted Power Service) (90) (battery bank to avoid power interruption while the emergency electric power plant starts) in order to temporally powering control circuits, computers, alarm system, an emergency lighting system, that is, all the vital systems until the power plant is in total control (there are two UPS, one in the bubble and the other in the infrastructure container). Control board of the compressors (92) will feed equipments (94) which are non lubricated "positive displacement" type compressors (with Teflon rings) and they can alternatively work or can complement to each other depending on the demand; in order to do that, each one is provided with its own complementary equipment as coalescentes filters (96), mesh filter, carbon monoxide to carbon dioxide converters, refrigeration dryer units (95), by-pass, safety valve, drainage, check valves, etc. Compressors will share a storage stainless steel or plastic tank (98), which will work at the pressure provided by the compressors (between 551,580 to 689,475 kPa) and will have its standard accessories (safety valve, check valve, manual and automatic drainage, checking hole, sensor entry adapters, manometer, etc.)

The tank is provided with a pressure throttle valve in its exit, it is usually adjusted at 413,68 kPa output. Then, air is driven to the bubble through a polyethylene piping (similar to natural gas distribution piping in cities) along the sea bottom, it is anchored to the sea bottom with concrete ballast and attached to a coupling in the lower part of the bubble with an adapter and from there, to a motorized valve (62) which regulates its entry of volume of flow, according to what it was specified regarding FIG. 8. It is convenient to provide the bubble with an emergency air regenerator system, by passing the same through soda filters as it is used in submarines, in order to use the same in case of compressors maintenance, and minimize the use of compressors.

Water networks are depicted at the bottom part of this figure: water is pumped from the drinking water storage tank (130) to bathrooms and kitchen, and through a hydropneumatic system (132) keeps the piping (134) and the bubble water network at a pressure of 344,737 kPa. Sewage collecting tank (136) which is located on the bubble fake floor and which is connected to the toilet, shower, dishwasher, lavatory, drainage pipelines, previously going through a sand remover and a grease degradator and it is periodically and automatically drained by a submerged pump (138) which sends this sewage to the coast through other polyethylene pipe (142) and then to the island sewer system or the closest place on main land.

In the middle part of the diagram, control systems and alarm system are shown. These systems communicate all about pressure, temperature, gas concentration, water level sensors, voltmeter, and so on (83) to the PLC and PC by data collecting cards and from those control circuits as power plant boards, compressors, electric power distribution etc. In general, the system is automatically controlled by the boards and transferences are connected to the PLCs and by themselves, although in order to make the control system more friendly to the personal maintenance, all these variables are fed to PCs, one in the bubble and the other a twin PC, in the infrastructure container, in order to check and handle the variables necessary for the whole handling of all the systems. With this, the bubble and its infrastructure becomes a truly "intelligent building" in which all the equipments and its operation are done by means of the mouse of the computers and a control software of the LAB view type. In FIG. 15 each one of the following numerals indicate:

(80) PLCs.
(82) PCs (personal computers)
(84) Aerogenerators (wind driven generators).
(86) City electric network.
(88) Diesel emergency power plant.
(91) UPS (uninterrupted power service).
(90) Power plant automatic transference.
(92) Compressors board.
(94) Non lubricated compressors
(95) Air dryers.
(96) Filters
(98) Stainless steel or plastic air reserve tank.
(130) Clean water storage tank.
(132) Hydropneumatic system.
(134) Polyethylene piping for driving clean water to the bubble.
(136) Sewage tank
(138) Sewage draining pump.

(140) Sand remover.
(142) Polyethylene piping for driving bubble sewage to mainland sewer.

Figure 16:
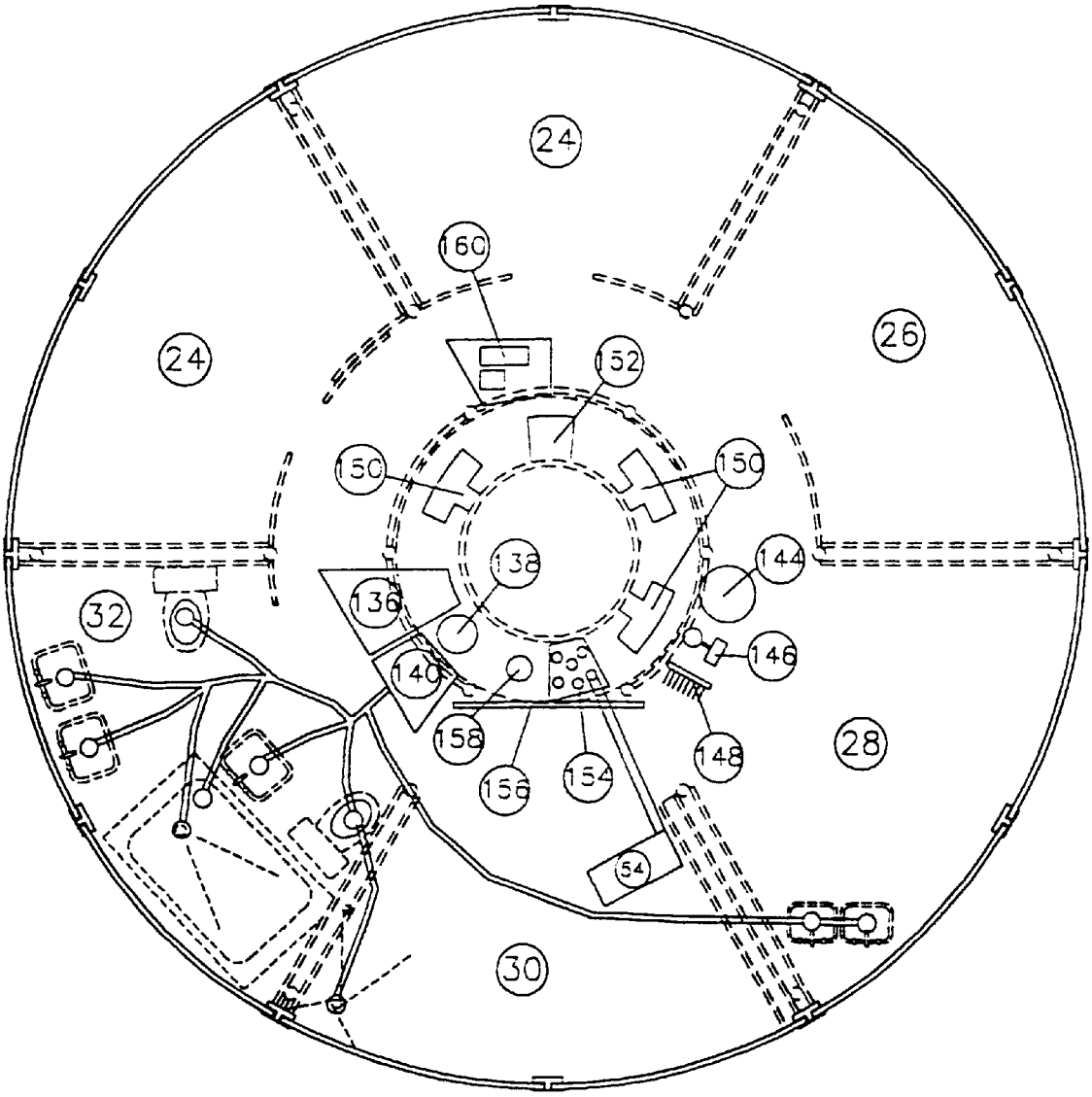

FIG. 16 illustrates the infrastructure distribution inside the bubble. They are shown in plant places, under the cabin floor (between the floor and the fiber-glass hulls in the compartments left by the metallic structure) the locations of the different equipments forming the infrastructure of the bubble, including shock absorbers for the level of the water thin sheet (150), feeder system (144, 146 and 148), hermetic chamber for hoisting engine and absorption muffler, which will be specified later. Noisy equipment such as pumps, motoreductors, expansion chambers, conditioned air equipment etc, have been carefully made with an isolated sound and vibration to avoid any disturb for guests. In FIG. 16 each one of the following numerals indicate:
(136) Stainless steel sewage tank.
(138) Sewage pump.
(140) Sand remover and grease reductor.
(142) Polyethylene sewage piping for driving sewage from the bubble to mainland sewer.
(144) Feeder tank for fish feeding.
(146) Hydropneumatic pump for the feeder.
(148) Feeder distributors towards external ejectors.
(150) Level attenciators for the water thin sheet.
(152) Chamber for the level sensor.
(154) Input/output of connections to the bubble.
(156) Door case.
(158) General drainage pump.
(160) Hermetic chamber for motorreductors and hoisting engines for the transportation system.

Figure 17B:
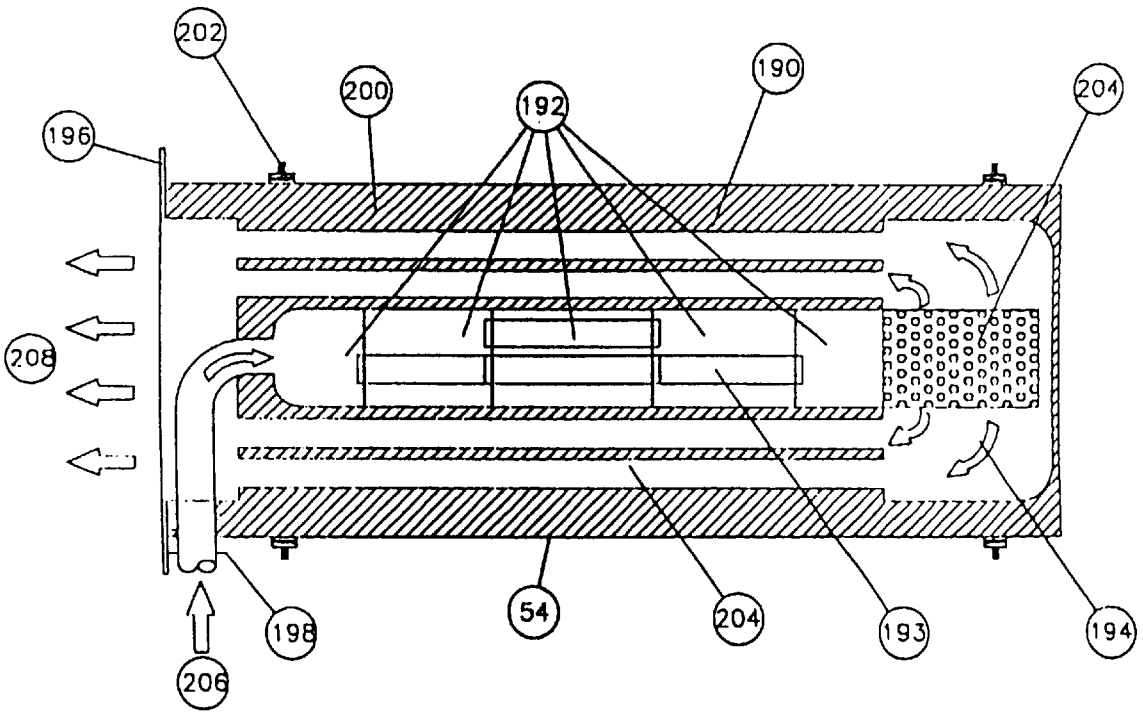
Figure 17A:
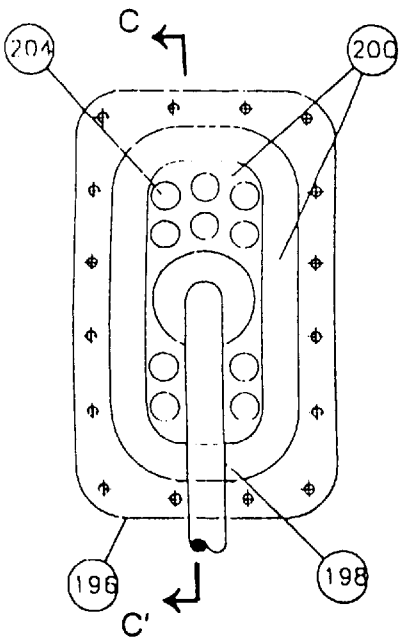

FIG. 17 illustrates an expansion chamber and muffler. The two steps (expansion and absorption) are found in a same body called muffler and expansion chamber. Its purpose is to receive the incoming air from the compressors at 413,685 kPa, and to reduce its pressure to 206,84 kPa (normal pressure inside the bubble), without generating noise, for which a two stage muffler has been designed: one step is "free expansion" (192) and the other one is "direct absorption" (190). The first one possesses five stainless steel chambers (192) that are linked through holed sheet tubes (193). Chamber sizes are different in order to disperse noise at different frequencies. Then, the flow passes through a transition chamber, changing flow direction by 180° (194) going through another stainless steel holed sheet. At the direct absorption stage (192), flow is divided into several holed tubes which are externally insulated with fiber-glass or loose rock wool protected with a fiber glass screen. Flow is collected at the tube ends (208) and driven towards the air conditioner equipment to be mixed up with recycled air. The muffler is externally acoustically isolated and it is provided with some anchorages suitable to avoid vibration, and in addition, with some flexible flanges at the flow entries and exits to avoid noise contamination. In FIG. 17 each one of the following numerals indicates:
(190) Direct absorption stage.
(192) Free expansion stage
(193) Stainless steel tubes in holed sheet.
(194) Transition chamber (flow direction change by 180 degree).
(196) Coupling flange.
(198) Flexible coupling.
(200) Acoustic insulating stuff
(202) Antivibration bearings.
(204) Stainless steel holed sheet.
(206) Incoming flow of compressed air.
(208) Coming out flow of expanded air.

Figure 18:
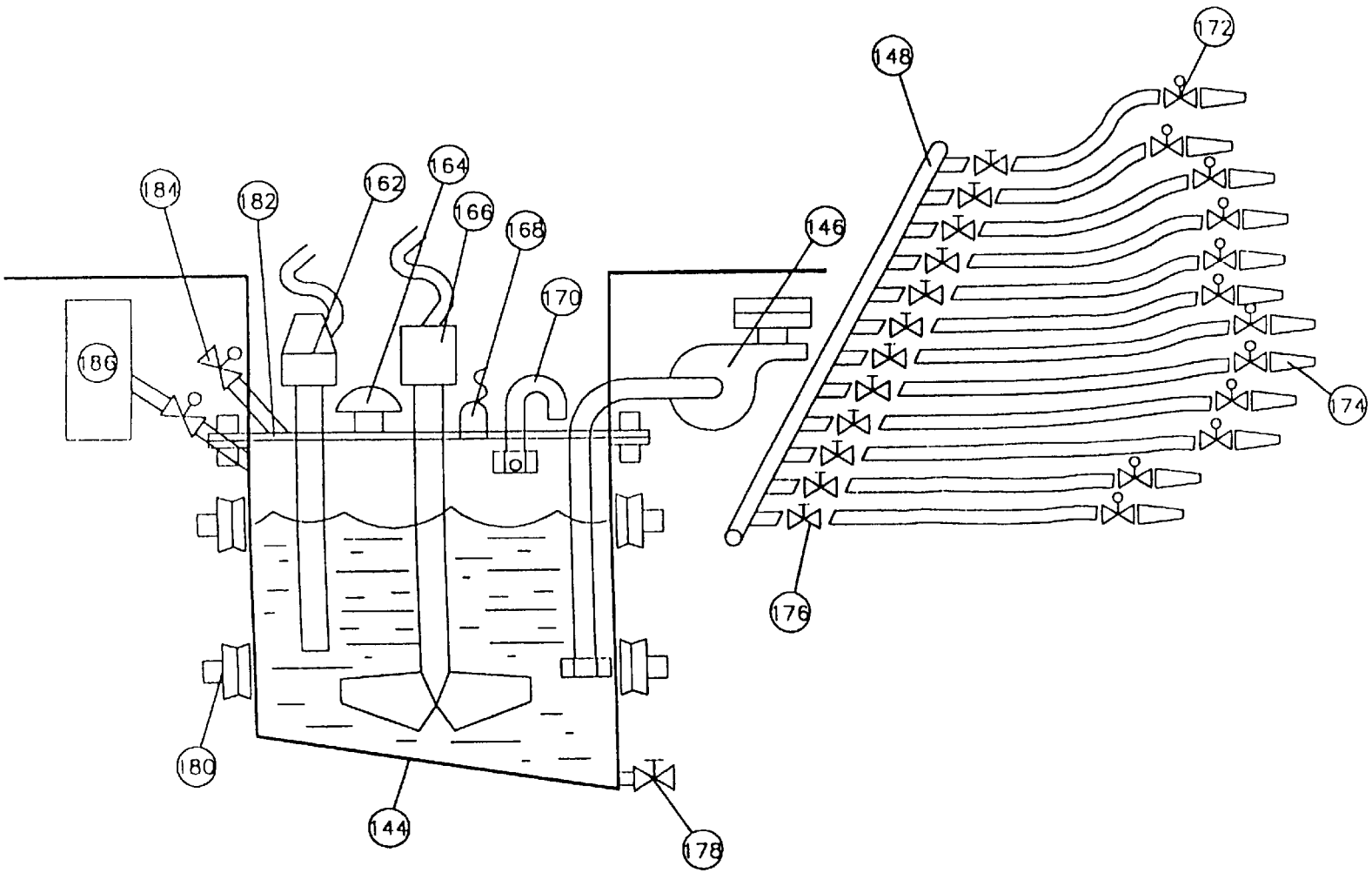

FIG. 18 illustrates the feeder system for baiting fishes. This system gets ready and distributes balanced fish food, that is, a granulated food suspension in drinking water, which is prepared in a tank (144) provided with automatic dosing means and agitators, and which is distributed by pipeline (148) which is pressurized by a hydropneumatic pump (146). Expulsion cones (174) or ejecting nozzles (316) are located on the bubble external part, at the same places where the polychromatic reflectors are located, and can be operated at will, by electrically plugging the output solenoid valves (172) on the four ejectors (two up and two down) that each bubble environment has. It is to be noted that although fish feeding is as one wishes, it is synchronizedly done with music, external illumination, outer compressed air shooting to produce ornamental air bubbles and the food dosing is automatically controlled by the control program and a PLC which can stop shooting in accordance with its programming, in order, to avoid fish overfeed or an over dosage of nutrients on water, that will produce alga over growing and coral whitening. For such reason, food dosage is controlled by the control software and this in turn it has been biologically studied in order to avoid any type of crossing contamination. In FIG. 18 each one of the following numerals indicate:
(144) Stainless steel feeder tank.
(146) Feeder hydropneumatic pump.
(162) Level sensor in the feeding tank.
(164) Hand hole of the feeder tank.
(166) Feeder tank agitator.
(170) Venting with retention valve in the feeding tank.
(172) Feeder system solenoid valves.
(174) Feeder system expulsion cones.
(176) Feeder system quick closure valves.
(178) Feeder tank drainage.
(180) Feeder tank antivibrators.
(182) Feeder tank lid.
(184) Solenoid valve for drinking water entry.
(186) Tank for granulated in the feeder system.

Figure 19:
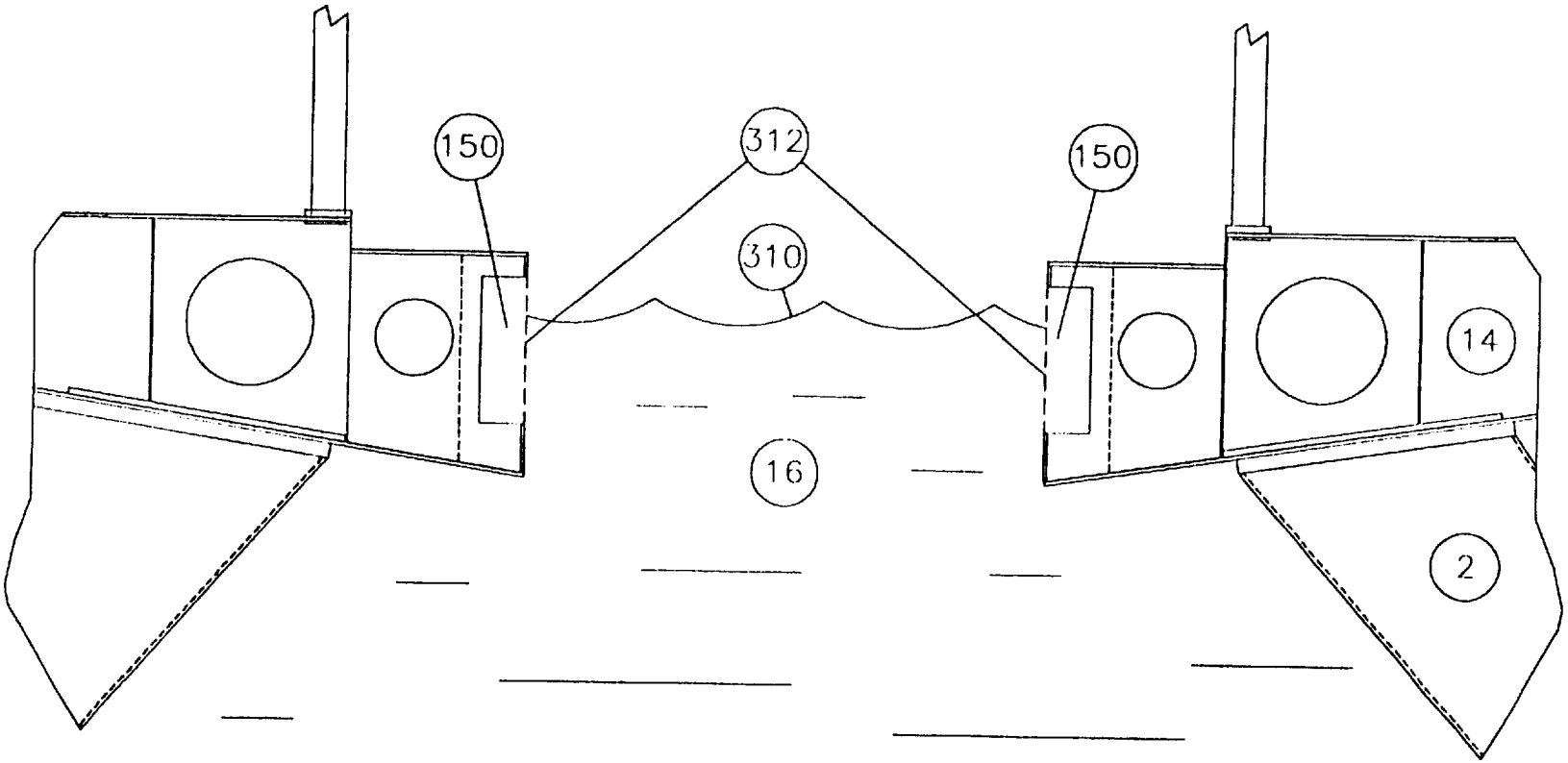

FIG. 19 illustrates a water thin sheet level attenuator. As it was explained in connection with FIG. 8, trapped air inside the bubble acts as an spring, with regard to the water thin sheet, and in addition, strong motion of the waves on surface will also produce level oscillating changes on that water thin sheet, due to sudden pressure changes (water column); for those reasons, the entry mouth of the bubble is provided with three "water thin sheet attenuators" (150) that is, three cavities or water receptacles that are communicated to the mouth or entry cylinder, through several holes or holed sheet (312) in order to keep some amount of water when the water thin sheet goes up, and then to return the water to the entry tunnel when the water thin sheet goes down. All the foregoing will happen due to the fact that the reaction capacity of the compressed air system is not so fast as to compensate the water thin sheet height oscillations and rather, it will be inclined to increase them. In FIG. 19 each one of the following numerals indicate:
(310) Water thin sheet
(312) Interchangeable holed sheet.

Figure 20A:
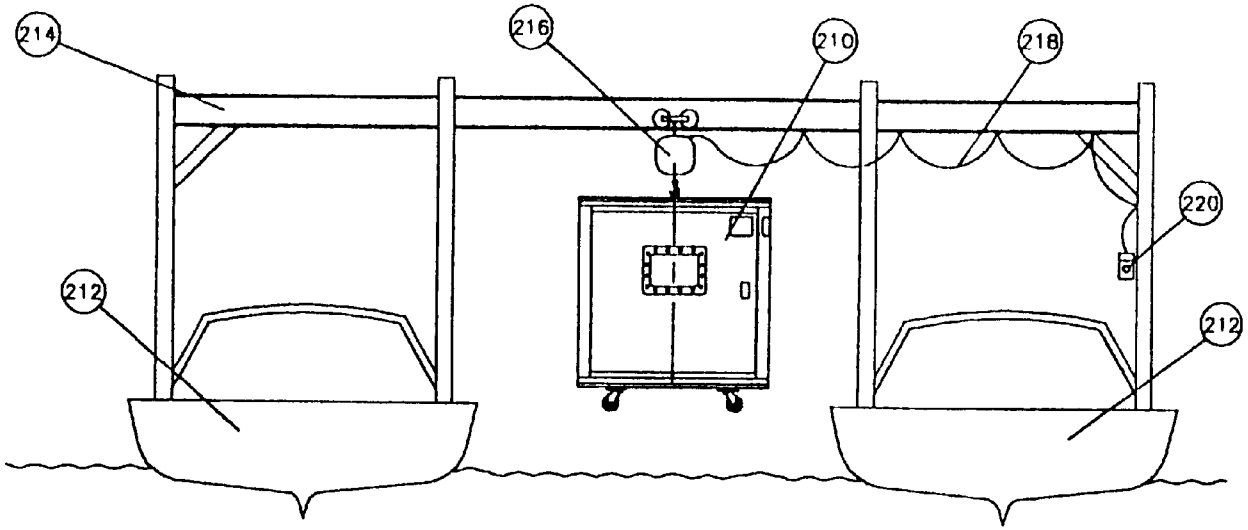
Figure 20B:
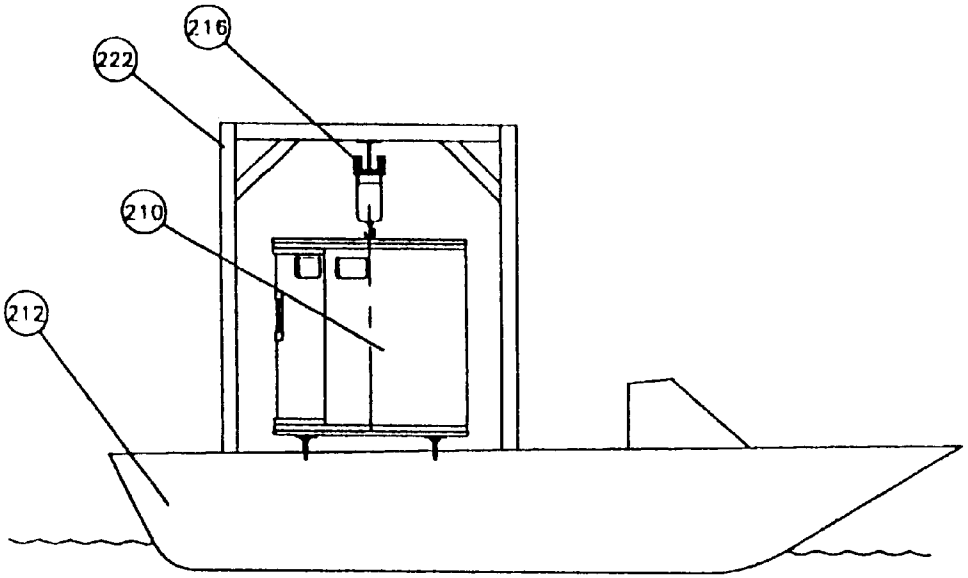

FIG. 20 illustrates twin boats to transport the container. In order to convey dry goods (no people) to the bubble, such as food, electric equipment, computers, guest bags, and to remove garbage, etc, a cylindrical steel container (216), about 1,4 $m^3$ capacity, 1300 kilograms weight, and sliding door and inflatable packing for hermetic sealing, have been designed. To transport this container and its easy lifting on land or on water, two identical boats (212) coupled by a tower (222) thus making twin boats by means of a cargo hoist track (214), as it is shown in FIG. 20, in front and lateral views. Cargo hoist (216) makes easier lifting and dumping the container using electrical devices (boat battery). In FIG. 20, each one of the following numerals indicate:

(210) Cylindrical container for transporting dry goods to the bubble.
(212) Twin boats.
(214) "I" beam.
(216) Lifting cargo hoist.
(218) Control and hoist cable.
(220) Electric control of hoisting machine.
(222) Tower of metallic sections.

Figure 21:
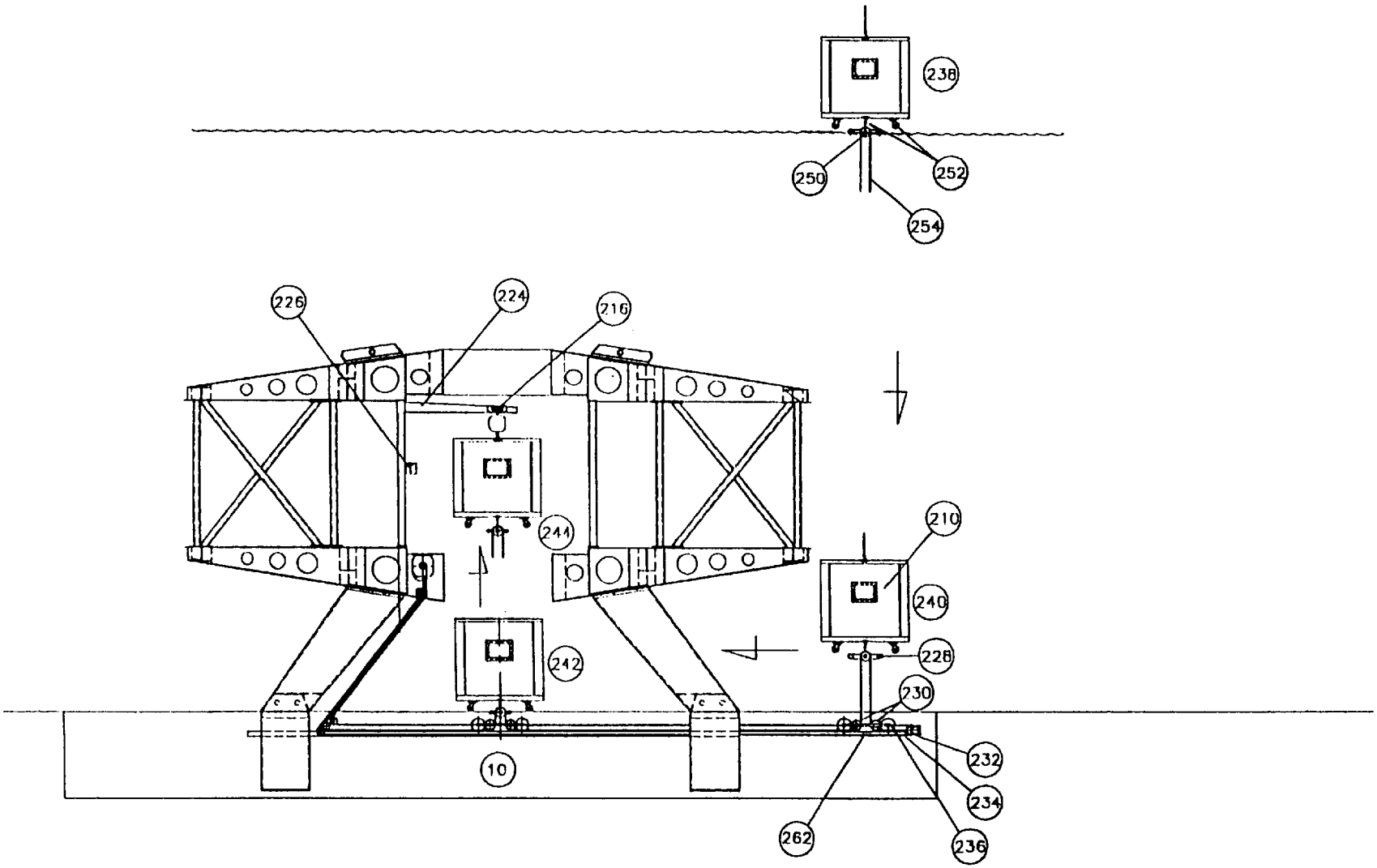

FIG. 21 illustrates a sinking hoist system of the container. In the bubble cross section it is clearly seen, the sea bottom, the sea surface and different position for the cylindrical container, which, before to be left on the water surface by the twin boats, must be hooked on its lower part by a snap hook (252) and a pulley (254), which will be floating on a zone near the bubble (238). Then, the container is dumped into the water and it will float spontaneously due to the fact that the weight/volume ratio is slightly positive. Then, it will be pulled down to the bottom sea by a cable (254) and the hoist of the vertical movement system, whose operation will be specified in FIG. 22. After reaching the bottom (position 240) the container is horizontally pulled by the car for horizontal movement (262) to position (242) just below the bubble mouth. In order to make it easier this movement and also the container handling on land, it is provided with rotable wheels located on its lower part and the container roll from the position 240 to position the 242 on the anchorage block surface. Once under the bubble entry mouth (position 242) the vertical movement system acts again, allowing it to float inside the bubble and from there to be lifted by the hoisting machine (216) and its supporting arm (224). Horizontal and vertical movement systems and the internal lifting inside the bubble are semi-automatically controlled (226) from inside the bubble. Once inside, the container is depressurized and opened to remove provisions or bags and then to fill it with compacted garbage, equipment, or bags which will be transported to main land. The container is sent out by reversing the process. In FIG. 21 each one of the following numerals indicate:

(224) Lifting arm.
(226) Hoist engines electrical controls.
(228) Toroidal float.
(230) Vertical movement pulleys.
(232) Horizontal movement pulleys.
(234) Horizontal movement track.
(236) Horizontal movement wheels.
(238) Position 1 (out of the water).
(240) Position 2 (at the bottom, on the anchorage block surface).
(242) Position 3 (at the bottom below the entrance mouth).
(244) Position 4 (lifting inside the bobble).
(250) Pulley.
(252) Snap hook.
(254) Stainless steel or fiber cable or wire rope.
(262) Horizontal movement car.

Figures 22A, 22B:
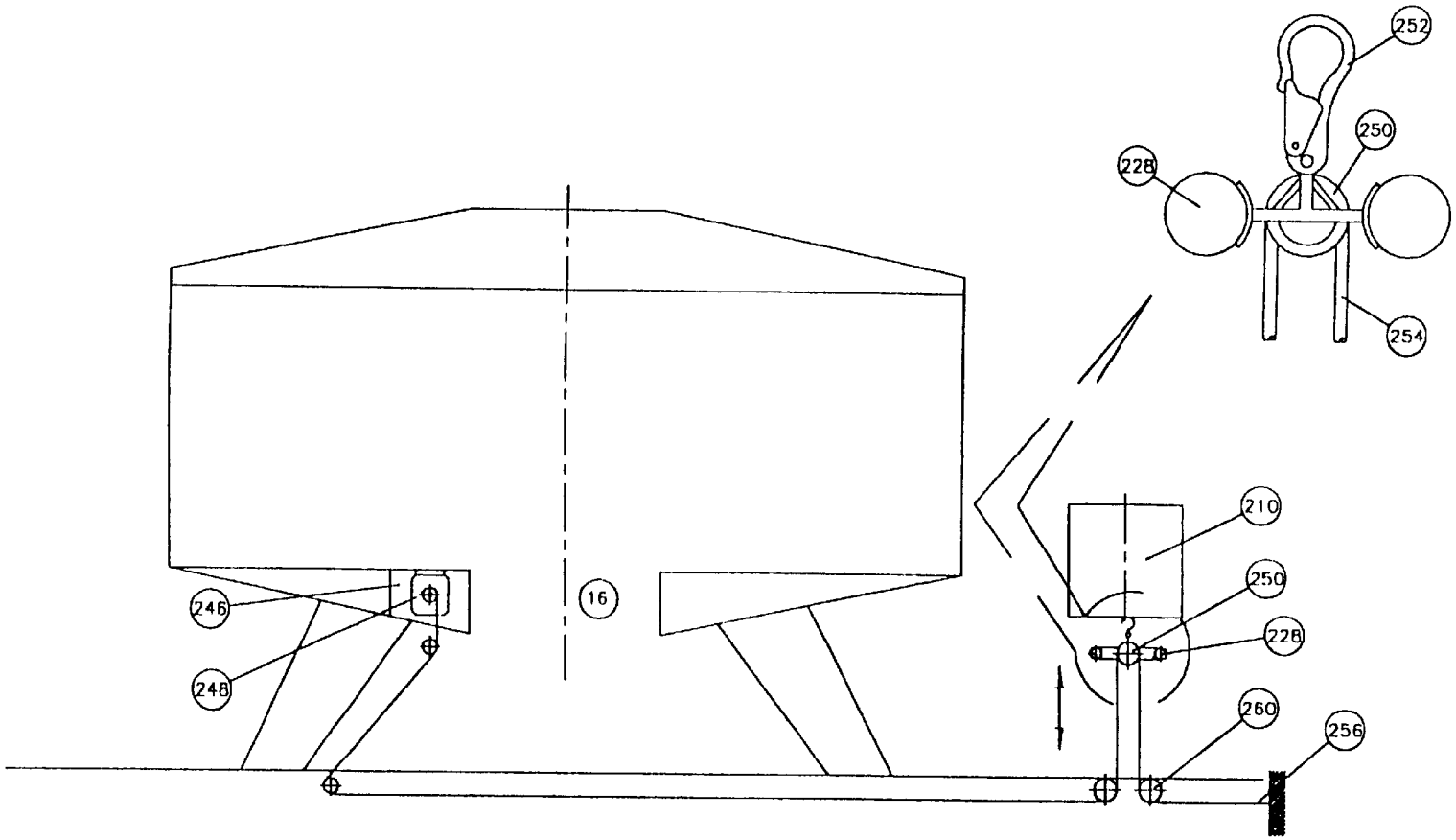

FIG. 22 is a schematic diagram of the horizontal movement. Vertical and horizontal movement systems used, they are similar to those used by construction cranes, but inverted, that is, instead of gravity acting downwards, buoyancy acts upwardly. Since the system is submerged into salted water, pulleys and rollings must be made of plastic or fiber-glass to avoid corrosion. Hoist engines are in an hermetic chamber (246) inside the bubble. And this chamber also works on the inverted cup principle, and it is automatically pressurized by compressed air, supplied by a pressure level sensor. FIG. 22 schematically shows how the cable (256) acts after being pulled by the hoist engine (248), moving vertically the container when the pulley (250) acts. This system allows also horizontal displacement with no essential height changes, keeping fixed the cable length, and anchored to the anchorage block. In FIG. 22 each one of the following numerals indicate:

(210) Cylindrical container.
(228) Toroidal float.
(246) Hermetic chamber for hoist engines.
(248) Hoist engine for vertical motion.
(250) Pulley.
(252) Snap hook.
(254) Cable or wire rope.
(256) Fastening of the cable to the anchorage block.
(260) Vertical movement pulleys.

Figure 23:
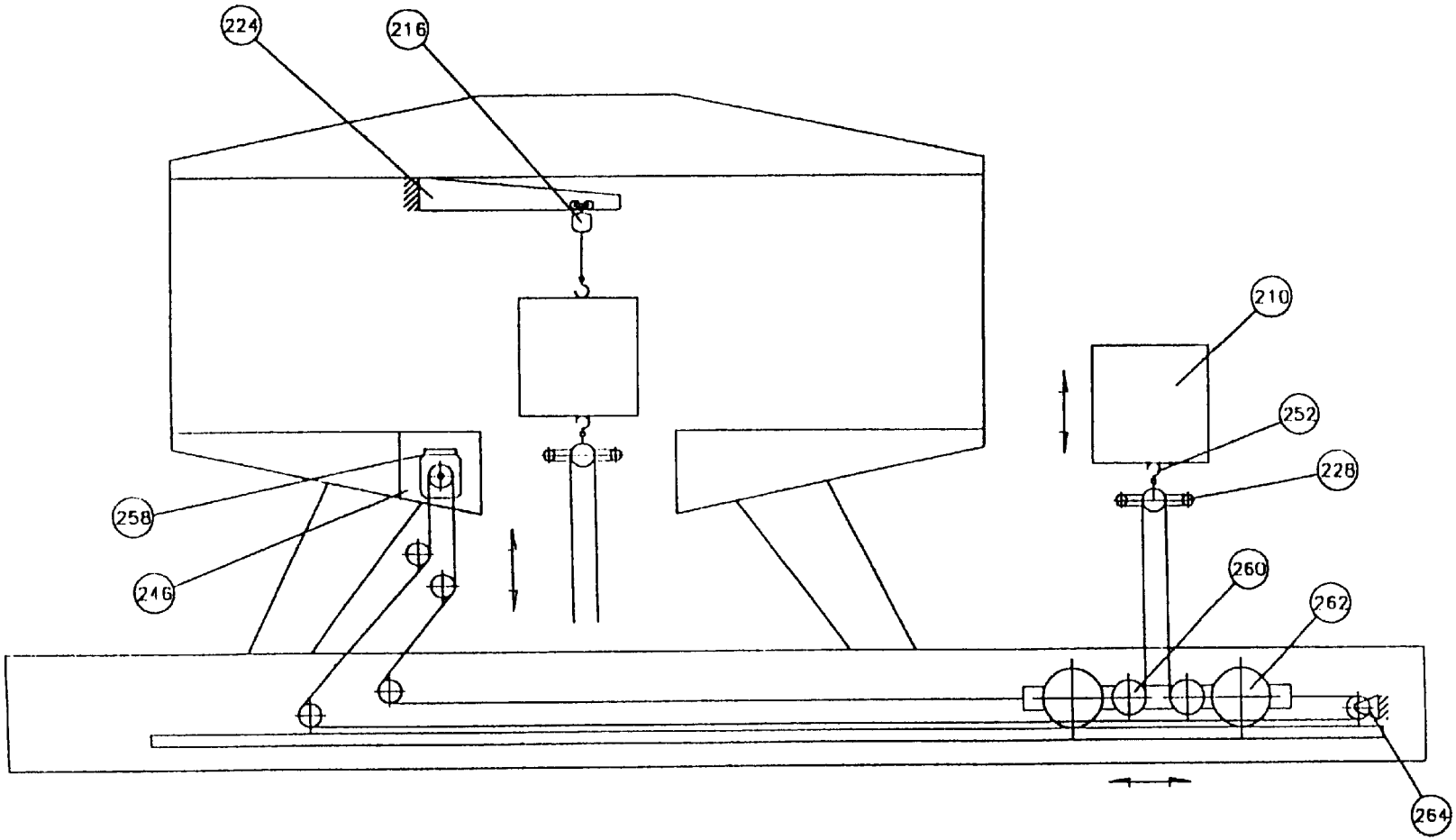
Figure 24D:
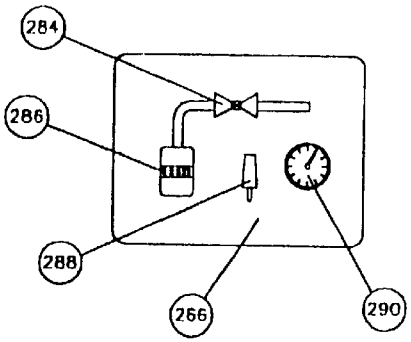
Figure 24B:
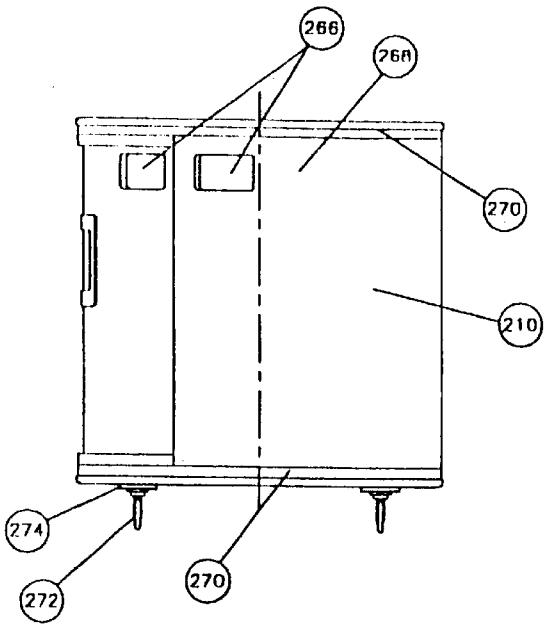
Figure 24C:
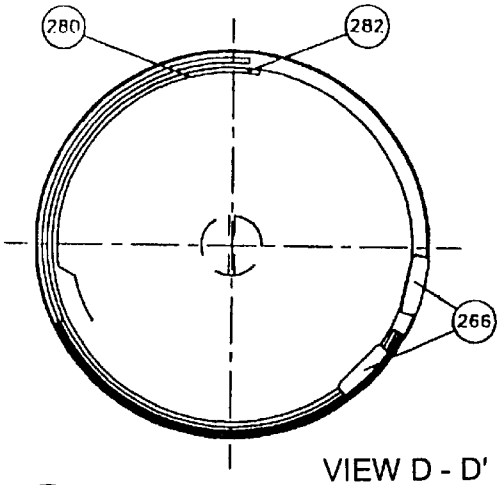
Figure 24A:
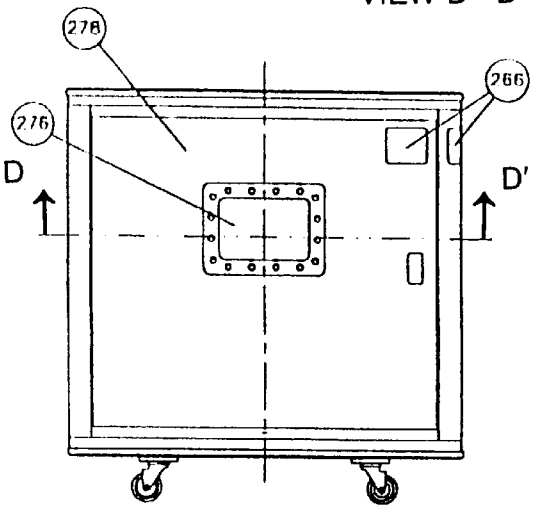
Figure 25D:
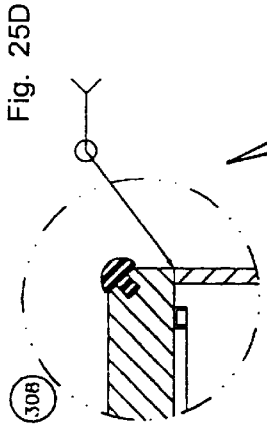
Figure 25A:
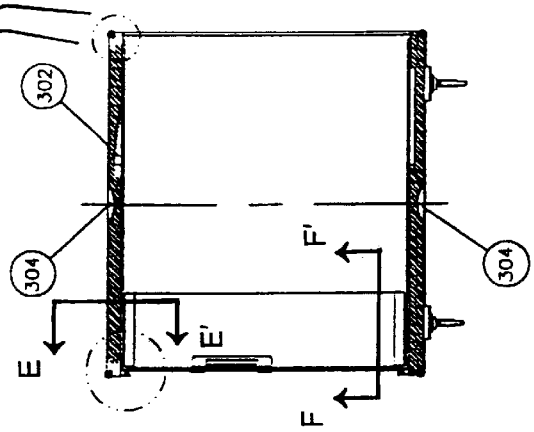
Figure 25C:
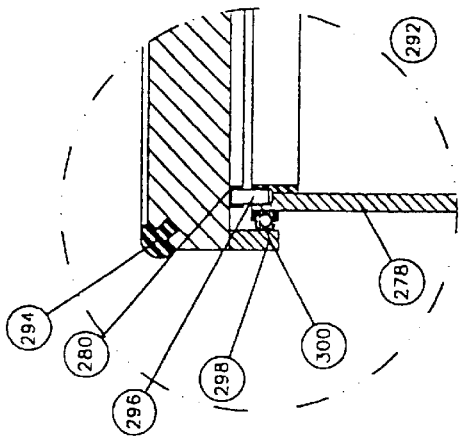
Figure 25B:
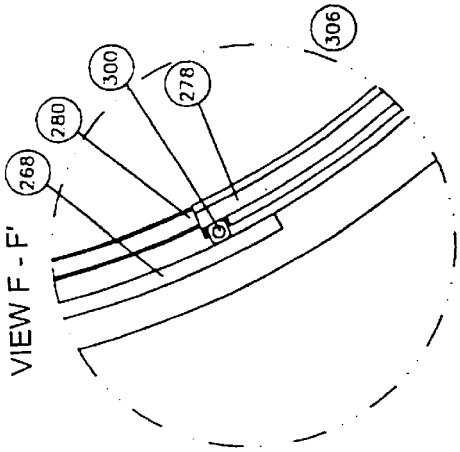

FIG. 23 is an outline of the horizontal transportation. The system of length of wire rope with fixed length and anchored at both ends to a car (262), which is rolling on a track anchored to the anchorage block allowing horizontal movement, by using the force from a hoist engine (258). The wire rope or cable is deflected 180° at the end of the travel by a pulley (264) anchored to the anchorage block. In FIG. 23 each one of the following numerals indicate:

(210) Cylindrical container.
(262) Horizontal movement car.
(264) Pulley, for horizontal movement car.
(246) Airtight chamber.
(258) Hoist engine for horizontal movement.

FIG. 24 shows a cylindrical container or metallic receptacle, which has appropriately been protected against sea corrosion by using Hempel type of painting and finishing. It has a sliding door which becomes airtight by means of an inflatable packing. After loading the container with goods, equipment or bags, which must arrive dry to the bubble, the sliding door (278) is closed and the inflatable packing (300) is inflated. Then the container is pressurized to about a little above 202,65 kPa that is, the bubble pressure; with this, the sliding door will be kept exerting pressure all the time against the packing by means of the accessories of the pneumatic board (266) of the inflatable packing and of the container, with said accessories permitting to safety inflate and deflate and the packing, by using compressed air. In FIG. 24 each one of the following numerals indicates:

(266) Instrument boards.
(268) Steel sheet body.
(270) Steel sheet lids.
(272) Plastic wheels.
(274) Wheel shock absorbers (spring).
(276) Viewing window.
(278) Sliding door made of steel sheet.
(280) Door track.
(282) Door shield.
(284) Stainless glove vale.
(286) Fast coupling.
(288) Safety valve.
(290) Manometer from 0 to 413,68 kPa.

FIG. 25 illustrates container details. It is shown the door details and its accessories, the lid internal slots for assembling the door from inside (in order to stand it once inside), the rubber perimeter protection, etc. In FIG. 25 each one of the following numerals indicates:

(292) Container door in detail.
(294) Rubber protection.

(296) Rollings.
(298) Steel flat bumper.
(300) Inflatable packing.
(302) Locating door slot and place for illumination.
(304) Hooking slot.
(306) Door track in detail.
(308) Welding in detail.

Figure 26B:
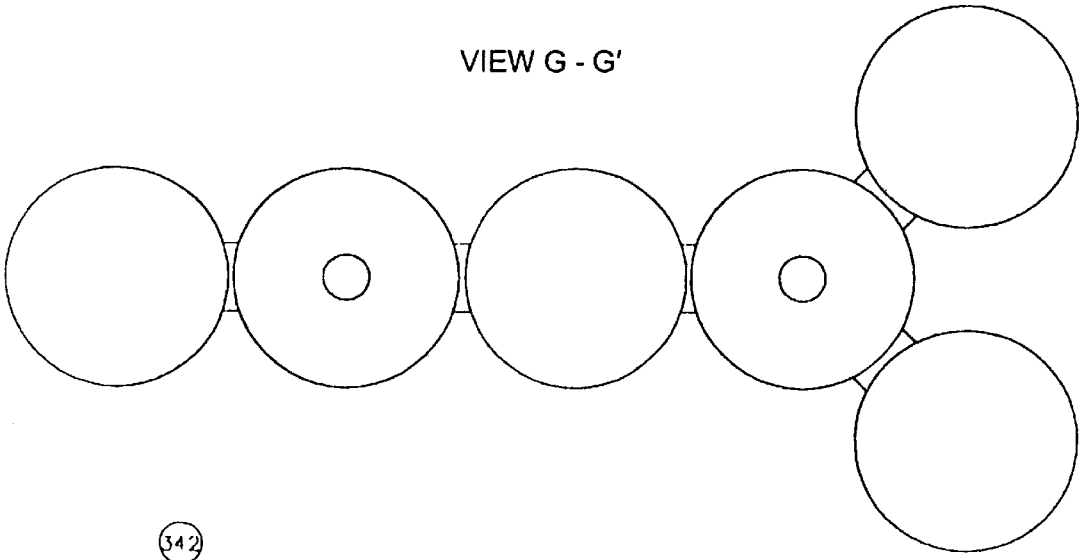
Figure 26A:
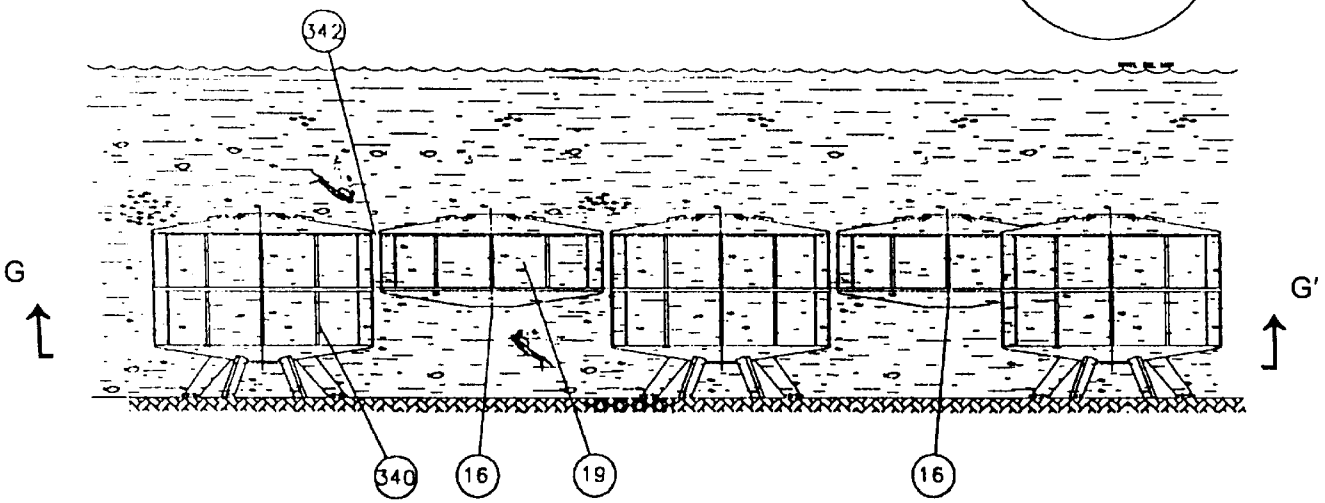

FIG. 26 illustrates a bubble coupling like cells. Performing some little changes, the bubble design allows to couple a bubble with more bubbles by means of airtight bridges (342) to form hotel complexes, hyperbaric hospitals or cities, joining the bubbles in vertical way (340), horizontal way or combining both of them. The vertical coupling requires an structural change since the middle structure is shared (the false floor in the upper bubble is the false ceiling in the lower one) and a spiral ladder for going from one bubble to the other. The horizontal coupling requires to change one of the acrylics for a flexible airtight bridge which allows small movements in each of the joined bubbles. For accessing to the complex, a single bubble must be joined to two double bubbles on second floor, this allows to dock a small tourist submarine at the lower entry of the single bubble, in order for transporting personnel and dry equipment. Double bubbles are previously coupled since their manufacturing on land and will be submerged in a similar way as a single one, and have no lower entry, since it is sealed and replaced by a lateral access throughout a joining bridge. Due to the existence of the water thin sheet at the entry mouth of the single cabin and another at the middle height in the double cabin, the external pressures on the double cabin is divided into an internal overpressure of about 41,368 kPa in the upper cabin, and an external overpressure of about 41,368 kPa in the lower cabin which allows to use the same design for the crystal-panaling and single bubble fiber skulls, anchoring the hole system to anchorage blocks which are proportional to the upright push from 12,19 m to 15,24 m depth. In FIG. 26 each one of the following numerals indicate:

(340) Double bubble (2 stories)
(342) Connecting flexible tunnel, for personnel crossing between cells.

Figure 27A:
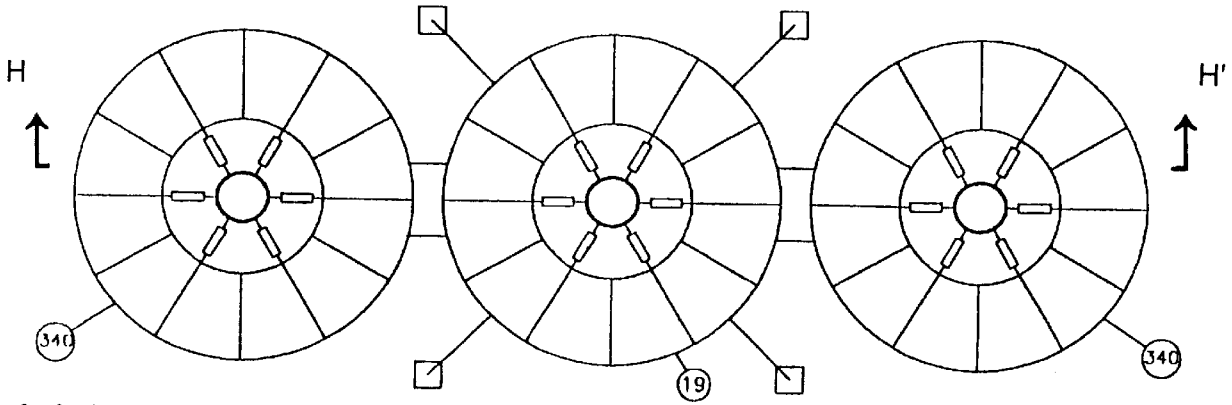
Figure 27B:
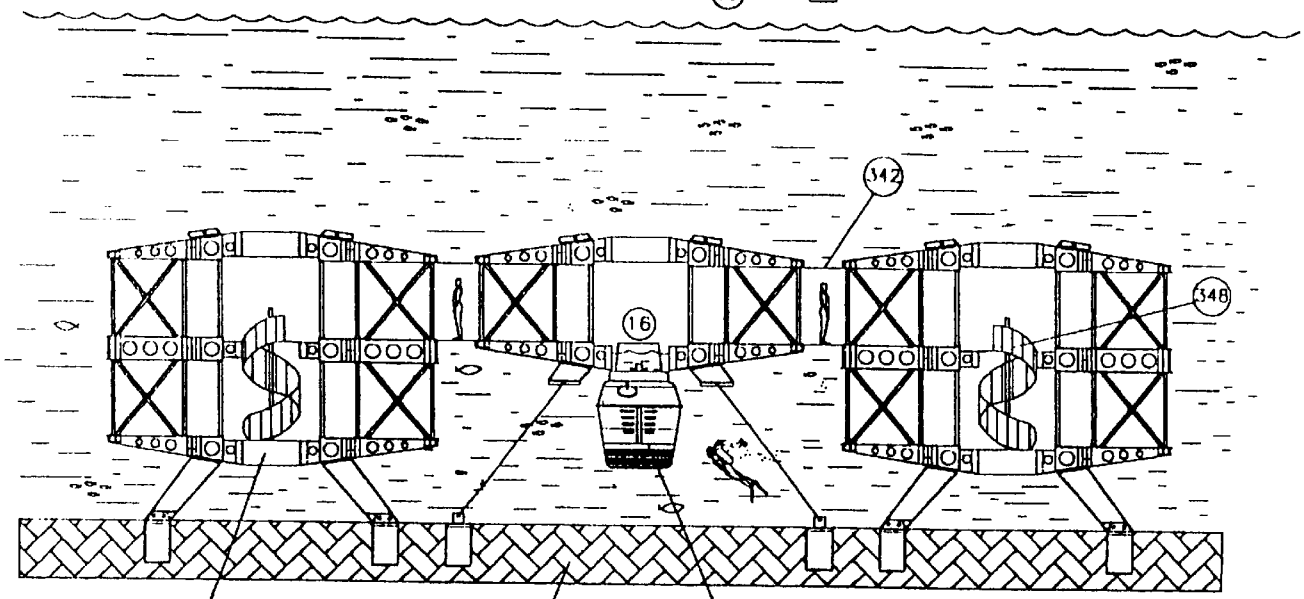

FIG. 27 is a cross-section view of a coupling. It is a cross-section view of what was explained in connection with FIG. 26. The intermediate single bubble must be anchored to the anchorage block independently from the neighbor double ones, in order to avoid transmitting exaggerated and unbalance stresses. In FIG. 27 each one of the following numerals indicate:

(340) Double bubble (2 stories).
(342) Connecting flexible tunnel, for personnel crossing between cells.
(346) Tourist submarine.
(348) Spiral ladder.
(350) Closed lower mouth.

Figure 28:
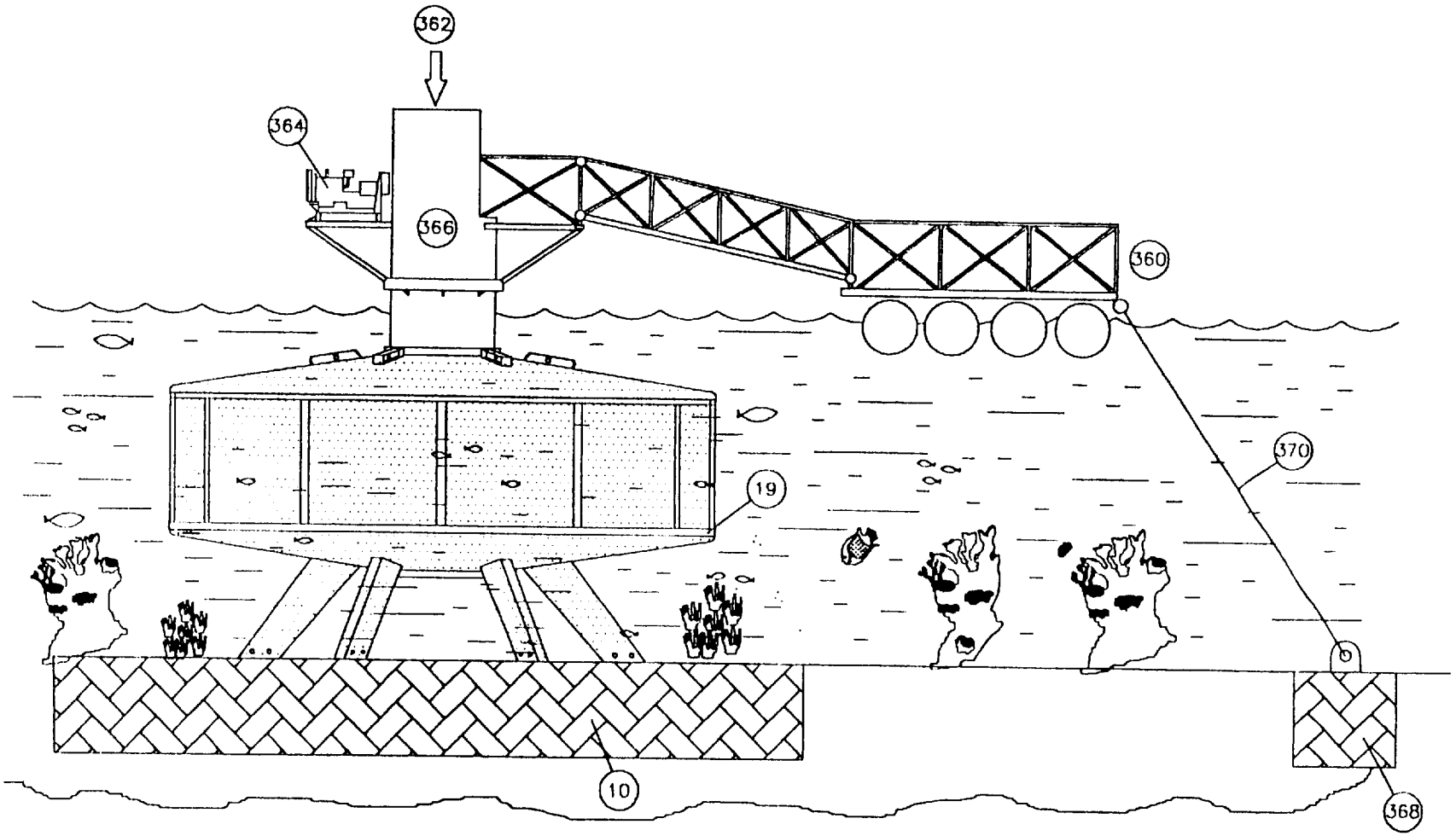

FIG. 28 is a bubble with upper entry. The same "bubble" cabin with its basic equipment can be used in an upper entry alternative (362), with its lower entrance covered and replacing the upper crystal-paneling by a fiber glass tunnel (366), allowing personnel access coming from outside, using the spiral ladder or an elevator at the tunnel entrance. In spite of having the same structure, equipment, anchorage block, installation procedure, etc, like a bubble with lower entrance, the most relevant difference among them is, that no compressed air unit is used to renewal the air inside the bubble since, with only a manager unit inside the bubble and a condenser (364) in the external part annexed to the tunnel entrance, with a conduit for renewal part of the volume of flow that is installed between the outside and the manager unit passing through the entrance tunnel, it is enough to keep a clean and conditioned air inside the bubble. In this application the maximum depth of installation is reduced almost to a half (from 12,2 to 6,096 m) avoiding in this way to change the thickness of covering materials (acrylics, fiber glass) which would be due to the fact that the external pressure is no compensated. Applications for this alternative could vary due to lower cost and a higher number of clients, since to be diving is not required in this case, as in the lower access option. It can be used as bar, restaurant, resting place, room, connected to the coast through the water, current, and control pipe lines, and if the coast distance is not too long a floating dock can be used to transport tourist by foot. If the distance is longer, this floating dock (360) could be short, anchored to the bottom by a cable (370) and carrying people on boats from the bubble floating dock to the coast dock. In FIG. 28 each one of the following numerals indicate:

(360) Short dock for boats, or floating bridge to the coast.
(362) Upper access.
(364) Air conditioned condensation unit.
(366) Fiber glass pipe for upper access.
(368) Anchorage block for cable tightener.
(370) Dock tensor cable.

Figure 29:
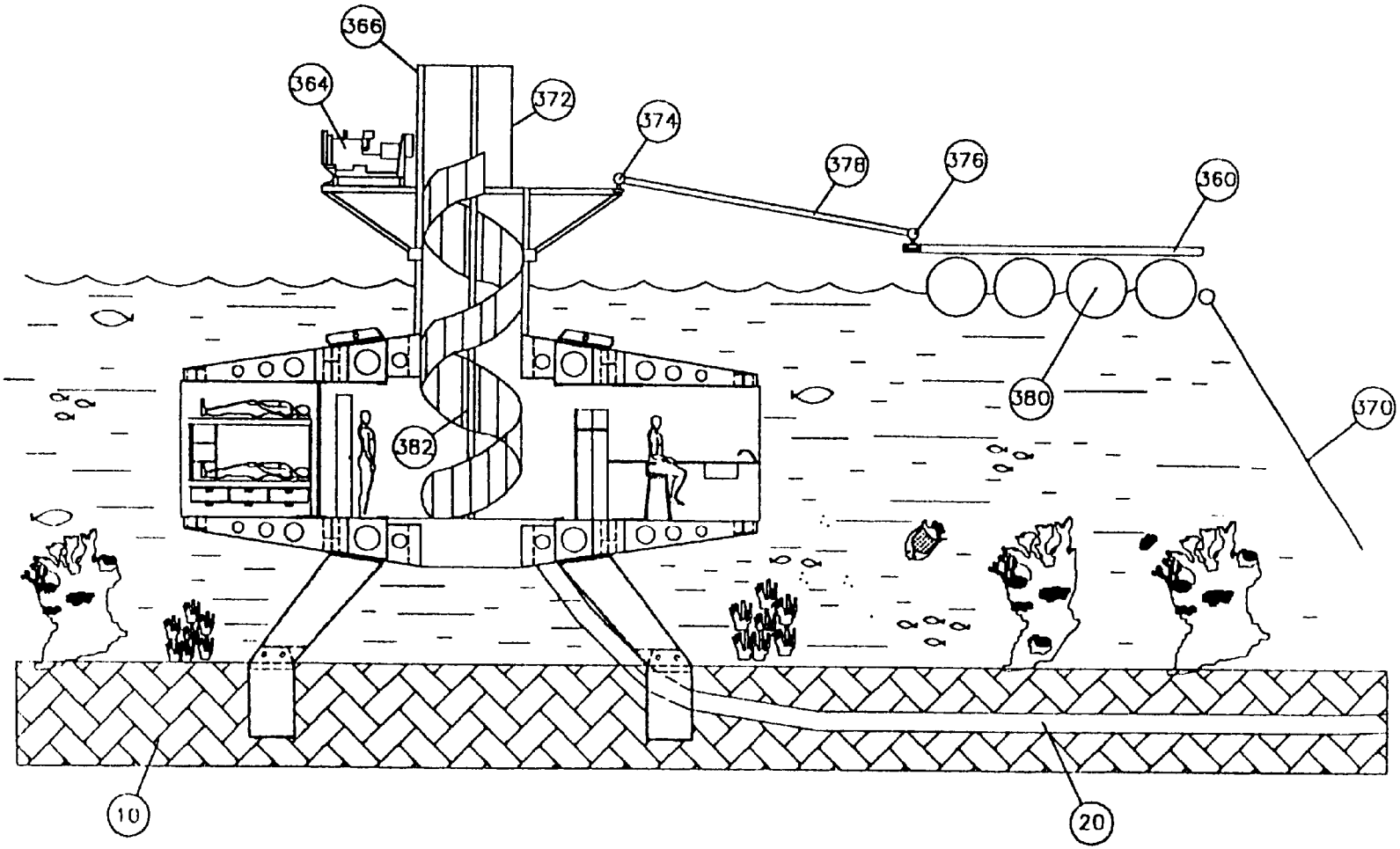

FIG. 29 is a cross-section view of the upper entrance bubble. In this cross-section view it is shown the access door (372), the spiral stairway (382), the basic structure is identical to that of the lower entrance bubble, piping (20) and the anchorage block (10) in similar way to the original alternative. The floating dock (360) is joined to the tunnel entrance (366) through a bridge (378) with two pivoting axes at the entrance tunnel end and three pivoting axes at the floating dock end, avoiding to transmit stress to the entrance tunnel and hence, to the bubble structure, generated by the movement of the floating dock due to wave action. In FIG. 29 each one of the following numerals indicates:

(372) Access door.
(374) Two axes pivoting system.
(376) Three axes pivoting system
(378) Pivoting bridge.
(380) Plastic floats.

Figure 30:
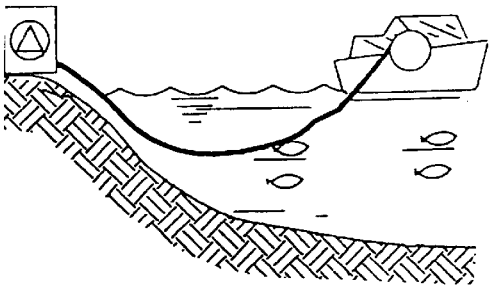

FIG. 30 illustrates pipe lines running from the infrastructure containers. Pipes are assembled among them on the boat and then dropped on the surface, when the boat left the coast towards the anchoring place.

Figure 31:
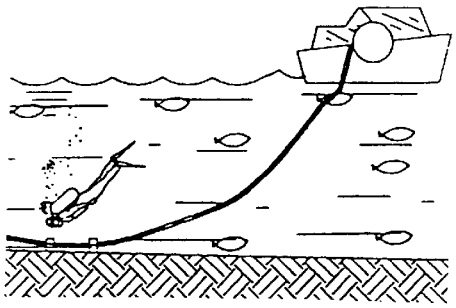

FIG. 31 illustrates the operation of anchoring pipes to the bottom. To compensate its floating tendency, the pipe lines will be anchored with concrete prefabricated pieces, following the pipe manufacturer recommendations about the distance between anchorage blocks, its weight and the needed caution to cause no harm to corals.

Figure 32:
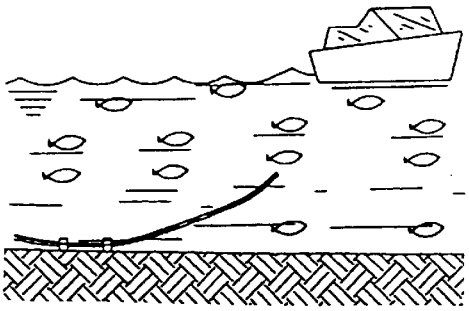

FIG. 32 illustrates the pipelines at the sea bottom. Pipelines are anchored until reaching one end of the bubble anchorage block and then fixed to that end by a sump previously installed for that purpose.

Figure 33:
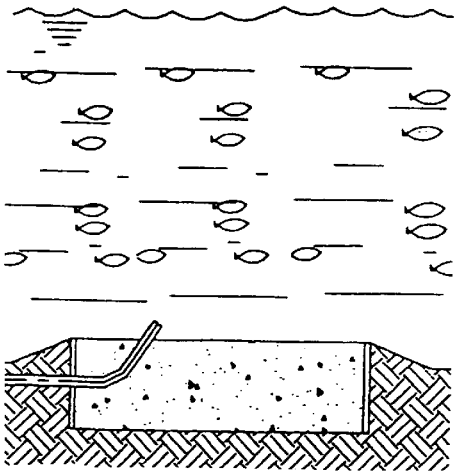

FIG. 33 illustrates pipelines which are fastened to the anchorage block. When they reach the bubble anchorage block, pipe lines are fastened to the block by coupling it to the sump on the block foreseen for that purpose, and closing it with concrete prefabricated pieces in order to fix the pipelines to the anchorage block. Pipelines ends are protected with appropriated couplings.

Figure 34:
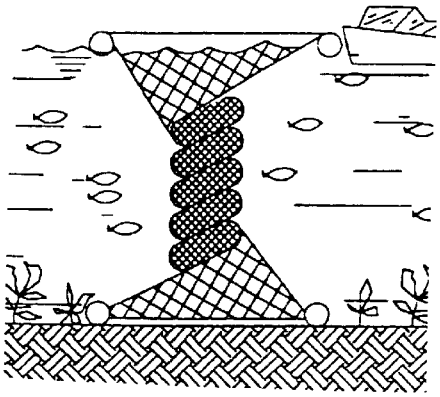

FIG. 34 illustrates the twisted screen positioning. In order to avoid any damage to animals around the selected anchorage place, a temporal closing of that area must be done, by using a fiber glass screen forming a cylinder, anchored at its lower part and with buoys at its upper part, letting it to expand until forming a cylinder avoiding any fish be trapped into its interior.

Figure 35:
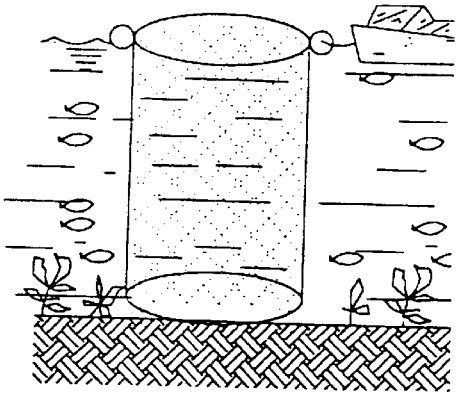

FIG. 35 illustrates anchorage place blocking with the screen. After the screen is expanded, buoys that keep floating the upper part must be fixed to the sea bottom with tension members in opposite direction to the closed area, in order to keep the cylindrical shape. At its lower part (on the sea bottom) the remainder screen is folded over its own end and it is anchored again, in order to keep the cylindrical shape as possible.

Figure 36:
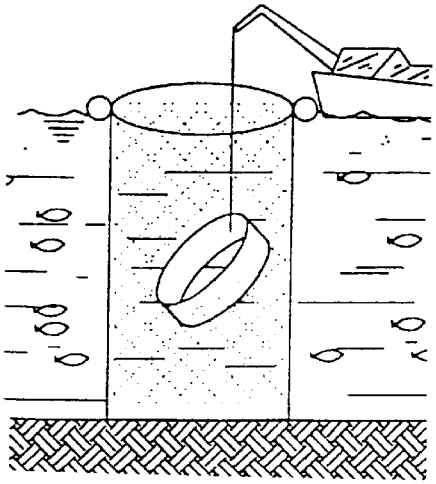

FIG. 36 illustrates the shaping ring installing operation to form the concrete anchorage block. Inside of the closed area, a rust-resisting metallic sheet ring is dropped, which has a 12 m diameter and 1,2 m height, and which will be used as the form to build an anchorage block.

Figure 37:
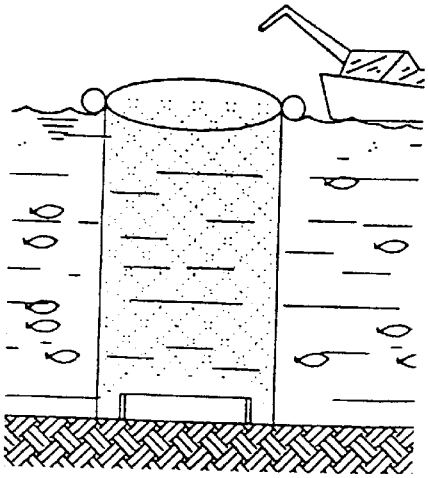

FIG. 37 illustrates the caving in of the ring into a sandy bed. Once it is placed at the bottom, the ring must be caved in as much as possible aided by vertical shocks from the surface. Latter the edges are leveled.

Figure 38:
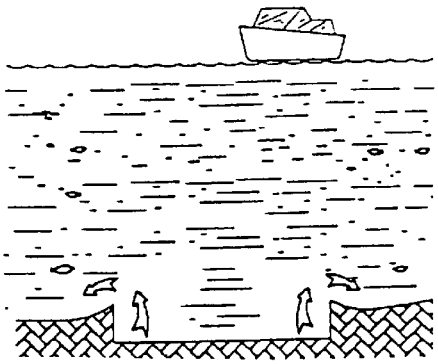

FIG. 38 illustrates sand dredging inside of the ring. Sand inside of the cylinder is extracted and dropped at the external edges, creating the place for the concrete anchorage block.

Figure 39:
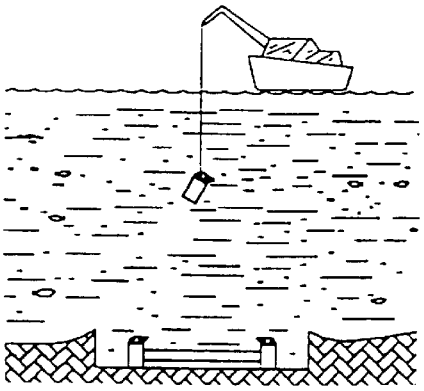

FIG. 39 illustrates the ingress of the cradles of the bubble legs. Dropped with the aided of a hoist, the component parts of the cradles for legs, which will receive the bubble legs, are assembled within the mold to be leveled latter. Previously, the lower reinforcement grid for the anchorage block has been placed at the bottom.

Figure 40:
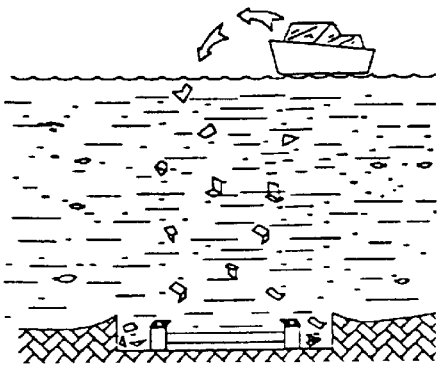

FIG. 40 illustrates the ingress of the scrap iron into the anchorage block cavity. In order to increase the anchorage block density, it will be placed 90 tons of scrap iron or cast iron such as car axes, engine blocks, cylinder heads, etc, filling previously their cavities with concrete and protected with epoxy paints for sea use. Finally, the upper reinforcement grid for the concrete anchorage block is placed.

Figure 41:
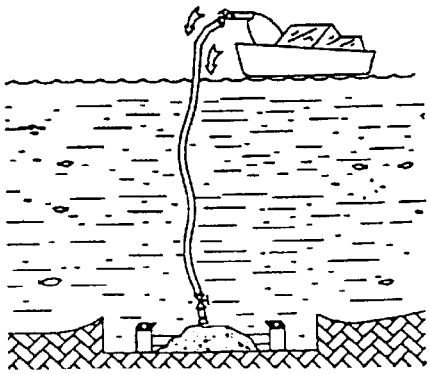

FIG. 41 illustrates the concrete foundry for the concrete anchorage block. Aided by a hose having an appropriated diameter and a regulator valve or damper at its lower end, the "trim" concrete is dropped and it will fill all the cavities in the anchorage block giving to the same the shape and weight, as to obtain a 269 tons weight monolith, with the anchorage accessories included and leveled.

Figure 42:
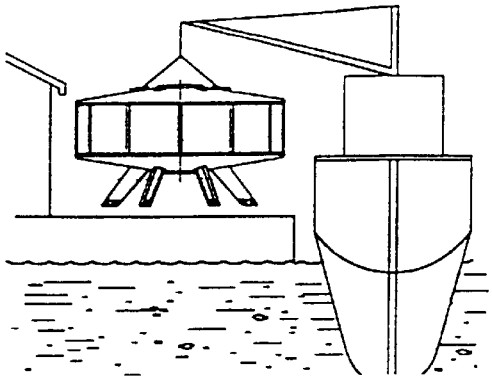

FIG. 42 illustrates the lifting of the bubble from the dock. After assembling the structure, hulls, crystal-panelings, and main accessories and after performing the hydrostatic tests prescribed as essential under overpressure and vacuum, the bubble will be rolled to the dock edge, where an enough large cargo boat (container carrier or the like) will lift it by means of its six upper handles, aided by chains and shackles and using its dragline boom which must have a capacity higher than the bubble weight (35 tons approximately), to drop it on the water surface.

Figure 43:
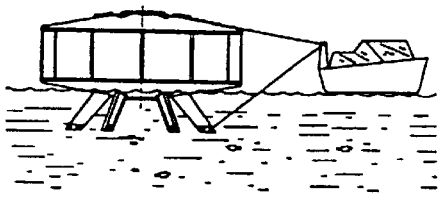

FIG. 43 illustrates the towing of the bubble to the anchorage place. Once on the water surface, the bubble will float spontaneously due to the air entrapped in its interior, and will keep its stability thanks to the higher weight of the legs at its lower part. With wire ropes and snap hocks the bubble will be towed by a boat to the place where the concrete anchorage has been cast.

Figure 44:
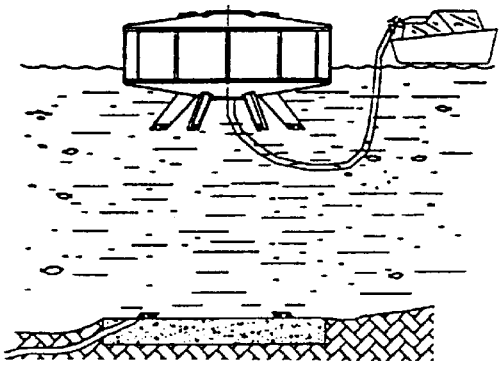

FIG. 44 illustrates the air evacuation from the bubble, in order to inundate it. When the cabin is floating directly above of the concrete anchorage place, a plastic hose will be installed from the internal part next to the ceiling through the entry mouth thereof to the towing boat where it is arranged a control valve. Due to its own weight, the bubble creates an inner overpressure on the trapped air by the inverted cup principle; this overpressure makes that the air flows spontaneously towards the outer space through the hose, allowing water to inundate the bubble, through the lower mouth. By using the hose exit valve, the needed air to reach a nearly neutral cabin buoyancy (lightly positive) will be evacuated, and at that moment, the bubble will be partially inundated.

Figure 45:
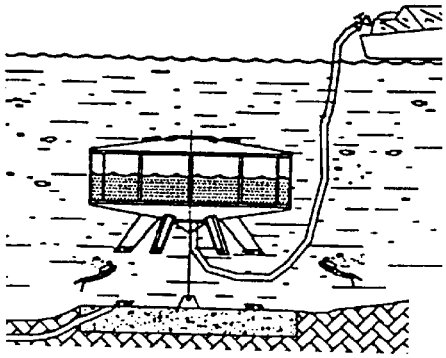

FIG. 45 illustrates the descending of the bubble with neutral floatation. Using a manual hoisting machine or "winch" which is anchored to the anchorage block and its wire rope tied to the bubble entry mouth, the bubble will be slowly descended, and thanks to the neutral buoyancy the legs will be oriented towards the cradles in the desired order. After the six legs are coupled into their respective cradles of the anchoring block, the twelve anchorage pins will be installed (two for each leg), which together with the anchoring block will guarantee that the bubble will not float. Thereafter, the pipes are previously installed will be coupled and anchored to the anchoring block and then, the air compressed valves will be opened in order to inflate the bubble with air coming from the compressors and hence, evacuating the water from inside the cabin. The residual water must be pumped with a drainage pump, and thereafter an inner wash with fresh water must be done, and then to proceed to move and install the equipment and furniture of the cabin.

DESCRIPTION OF THE INVENTION

Regarding the following description, the number inside parenthesis designates the part that is wished to be shown in the next mentioned figure.

As it is observed in the general view of the structure, FIG. 11, this consists of two sections, an upper one and the lower one, both of which are identical except for the legs (2), FIG. 11, at the lower section, which are replaced by lifting handles (8) FIG. 11 in the upper section. Each section consists of ribs (100) and (102), FIG. 11, arranged in a radial way, of "C" channels with transverse reinforcing members (104) and (106), FIG. 11, of "I" beams forming a hexagon. The six main radial ribs are joined together to a cylinder and the six secondary ones are joined to the inner transverse members. The upper and lower sections are joined by eighteen vertical columns (108), (110) and (112), FIG. 11. In order to avoid transversal movements, these upper and lower sections are reinforced by means of six crosspieces (114), FIG. 11, disguised in the dwelling place walls. Some of these crosspieces could be replaced by braces or corner brackets to provide more amplitude to the architectonic design. All the structure is made of carbon steel, cleaned by means of a sandblast process, before to be assembled and previously covered with finishing anticorrosive epoxic paints, for maritime use of the Hempel type. To the legs (2) and (12) and the lifting handles (8), FIG. 11 (which are outside of the fiber glass casing and will remain in direct contact with salted water), will be given an additional protection of 6 mm of rhinolining (a high resistance polyurethane layer) which will provide the needed protection against corrosion and shocks.

The rounded holes (116), FIG. 11 on the ribs allow passing to water, air, electric current, etc. pipelines, both in the false floor as in the false ceiling. The structure as a whole has been designed to resist both, earthquakes and water currents of 1 m/s, including the effects of both of them simultaneously. The importance of this structure in the functioning of the bubble, lies in its capacity to resist and uniformly distribute on the whole area of the fiber glass hulls, the ascending push of about 200 tons exerted on the bubble, counterweighted by the 269 tons from the anchorage block. The twelve anchorage pins (118) FIG. 11 (two for each leg) will resist a total of 200 tons ascending push. The design of the ribs (14) FIG. 14, "C" channels allows to place the screws (326) FIG. 14 that will join together the fiber glass hulls (320) and (322), FIG. 14, to the structure (14), FIG. 14, and at the same time will perform the coupling among them in the step form with packing (336) and sealing (334), FIG. 14, thus forming a whole easy to transport by pieces, with the option to be assembled in any place.

The design that is here presented is a cabin (19) FIG. 3, having an structure made of steel (14) FIG. 2 covered with fiber glass (4) FIG. 2, reinforced with polyester resin and 360 degrees for outside total lateral view through Plexiglas windows (6) FIG. 2. With a total area of 70 $m^2$ possesses all the commodities of a modern apartment, FIG. 4 and FIG. 5, for housing eight divers for an undefined term who will enter through the lower opening or lower access (16) FIG. 2, which works by the "inverted cup" principle, (or in other version, FIG. 28 and FIG. 29 through the upper tube (366) that communicates the cabin to the surface).

Such bubble is anchored to the sea bottom by means of a an anchorage block (10) FIG. 3 of about 269 tons made of concrete and 50 m to 1 km afar from the beach, FIG. 3, where two containers are located (22) FIG. 3, which will lodge the infrastructure equipments such as compressors (94) FIG. 15, power plant (88) FIG. 15, pumps (132) FIG. 15, etc. that through polyethylene piping (20) FIG. 3, anchored to the bottom sea FIGS. 30, 31, 32, and 33 carry air (44) FIG. 8, water (134) FIG. 15, and electric current to the bubble and after used there, returning water (142) FIG. 15, and the discharged air (46) FIG. 8 to the beach (the air to be delivered out of the sea and the water to be threw to the local sewer) in order to avoid any type of contamination or environmental change around the bubble anchorage zone.

The bubble possesses an air conditioned system, FIG. 6 and FIG. 7, that provides an average temperature from 22 to 23 Celsius degrees and a relative humidity of 50 to 60%; a dual system of oil-free compressors (94) FIG. 15, which alternately or jointly, upon necessity or occupancy status of the bubble, will provide filtered air and free of carbon monoxide for the breathing of the people lodged in the cabin; (in the upper entry version, FIG. 28 and FIG. 29, which is for a no higher to 6,096 m (20 feet) depth, the air is directly obtained through the upper tube where the entry (372) FIG. 29 to the cabin is located and the condensation units (364) FIG. 29, of the air conditioned equipments.

The renewal, filtering and conditioning of the incoming air to the cabin are driven throughout a totally automatic and redundant system depicted in FIG. 15, controlled through a PLC (80) FIG. 15, and monitored through two PC (82) FIG. 15, one in the infrastructure container and the other in the bubble, assuring in this form that all the time, air supply is fitted for breathing and avoiding water ingress or air leak through the lower door.

It is also provided with a hydraulic system of feeders, FIG. 18, in order to feed fishes around the cabin, which dose such food in such a way as to avoidany excess of nutrients in the water.

The cabin will be assembled and hydrostatically tested at the beach (in the dock), and then it will be lifted by the crane of a boat FIG. 42, and placed on the water surface; latter it is towed by boats to the selected place, FIG. 43, where previously the concrete anchorage block has been cast and the supply and return pipings has been anchored. There, the bubble is semi-inundated, FIG. 44, through a venting pipe with regulation valves until its floatability is almost neutral (lightly positive) and aided by a hoist anchored to the anchorage block, the bubble is sank, FIG. 45, until its six legs match on their beds (12) FIG. 2, and thereafter the twelve anchoring pins are placed (118) FIG. 11, the pipelines are connected to their places, (154) FIG. 16, and the bubble is "inflated" by using external compressors, (94) FIG. 8, thus displacing the water from its interior and pumping the remaining water. Then the interior thereof is furnished by entering the "dry" accessories by means of a container or hermetic steel cylinder, (210) FIG. 20, which is moved by wire ropes and pulleys, (254) and (250) FIG. 22, to drive it from the surface, (238) FIG. 21, to the interior of the cabin, (244) FIG. 21, where it is depressurized to open its lateral door, (278) FIG. 24, and to take out the things transported therein. During the casting process of the concrete anchorage (10) FIG. 1, it will be done a lateral closing from the bottom of the sea to its surface, using a fiberglass screen cylinder, FIG. 35, provided with upper and lower rings and which is twisted installed, FIG. 34, in order to, once put it in place and the lower ring anchored, turn the upper ring untwisting the screen cylinder and expanding it, FIG. 35, assuring in that form that no fish will be trapped in its interior during the temporal closing; this guarantees that while the materials for the anchorage block are submerged, FIG. 40, neither damage nor hurt to any animal around is done. Once the construction of the anchorage block is over, the screen is withdrawn by reversing its installation process.

In order to cast the concrete anchorage block a coral free place, with sandy floor, and of at least 15 m of diameter and preferably of about 10,66 m to 12,19 m (35 to 40 feet) depth, and at most 1 km far from the beach is selected (about 4,57 to 6,10 m depth in the upper access version of FIG. 28 and FIG. 29). After the above described blocking process, using the screen, FIG. 35, is done, a steel sheet cylinder is lowered, FIG. 36, the cylinder having 12 m diameter and 1,20 m height to be placed on the sea bottom and to be sank into the sand as much as possible, FIG. 37, and to drag the sand form its interior, FIG. 38, and to drop the dredge sand at the outer side thereof, thus making place for the anchorage block. The anchorage block will consist of grids made of steel rods, high density steel scrap, FIG. 40, such as engine blocks, cylinder heads, axes, etc and concrete FIG. 41, pumped from the surface and which is cast on place, using as straightedge the steel sheet cylinder described above. Also cast into the anchorage block will be the steel legs (12) FIG. 11 and FIG. 39, which will be used as bed for the bubble legs and these will be anchored there, once the cabin is sank.

If the selected place is rocky and according the results of the hardness and adhesion testes, the anchorage can be done with nailing blocks and epoxics to the rock thus avoiding the ballast construction.

Its volume consist of a cylinder (transparent part (6) FIG. 1) and two trunks of cone (84) FIG. 1, one at the cylinder upper part and the other at its lower part one mirror image of the other, made of fiberglass and polyester resin.

These trunks of cone are conformed each one by 12 external hulls (320) FIG. 12, all of them identical each other and 6 inner hulls (322) FIG. 12, in order to minimize the number of molds involved in the construction. The entry door at the lower part (16) FIG. 2, is a fiberglass cylinder making in this manner a total of only three molds in order to build the whole cabin without lid, and the upper window (66) FIG. 2 is covered with a plexiglas circular window (66) FIG. 9. (In the upper entry version, FIG. 28 and FIG. 29, it will happen in the inverse way).

Uses or applications are diverse. The dwelling place with a usable area of 70 $m^2$ and a volume of 200 $m^3$ can be used as apartment, hotel room, restaurant for divers, bar, diving teaching place, inverted aquarium, gym, scientific research station, reef monitoring, hyperbaric chamber, etc, just performing some changes on the distribution of the inner walls and in the furniture according to the user's necessities and will. All the materials that are used in its construction, including paints, fulfil the sanitary norms, which makes the cabin and its installing ecologically 100% and free of contamination.

In addition, beside the direct and indirect inner illumination, the design is provided with an external illumination consisting of 60 polychromatic reflectors (314) FIG. 12, in order to highlight the animals and flowers, for the day and night, combining the illumination synchronically with surrounding music, from a computerized mixer system, including the automatic control of the feeding system FIG. 18, for feeding fishes, setting up in that way a "natural show" that integrates music, controlled illumination, native animals and ornamental bubbles.

Both the bubble and the infrastructure containers are provided with signal and alarm system (83) FIG. 15, they are controlled by PLCs, (80) FIG. 15, one outside (at the equipment container) and the other inside of the bubble. The foregoing system is provided with sensors for carbon monoxide concentration, fumes, oxygen, water level at the entry door, sealing control, remote closing control of the valves, handling and monitoring of compressors and its diverse parameters (pressure, temperature, etc.), handling and monitoring of the power plant and external power sources through the automatic transference, control and handling of water pumps and the tank levels, temperature and relative humidity, control of the air conditioning system, temperature and relative humidity, fire evacuation alarms, inundation or concentration of gases and control of the audible and visual signals of these alarms (83) FIG. 15. Although all the systems are automatically controlled by the PLCs, monitoring and remote control is done by the two PCs through a control software which allows the visualization of all systems on the computer screen and the manual control and change of the variables using the keyboard and the mouse of the computers.

The bubble will be used as hyperbaric chamber too, in order to extract the nitrogen from the blood absorbed by persons who stay there for more than three hours for which an hermetic door is installed at the entry mouth (16) FIG. 2, (only for the lower entry version) and the control system is settled in the function of "hyperbaric chamber". On this function the inner pressure is decreased to 151,68 kPa, remaining for six hours at this pressure (or during the whole night in order to avoid disturbing the guesses) and later to come back to the pressure of 202,65 kPa, and to proceed to evacuate the bubble users avoiding in this way any problem by the effects of decompensation due to nitrogen absorption (saturation diving). The design of these bubbles can be used as cells of hospital or hotel complex, FIG. 26, and FIG. 27; by making some structural changes but keeping their shapes and sizes, they can be piled up one above the other (340) FIG. 26, as well as to be set side by side, (19) FIG. 26, connected together through flexible tunnels, (342) FIG. 26, allowing people to cross from a module to another without any restriction on the natural moving of each set. At the lower parts of the one story modules which are linked to the second floor of the double modules will be located the entry mouths for divers, (16) FIG. 26, and tourist submarines, (346) FIG. 27, which will be allowed to dock there transporting dry tourist (no divers), equipment, groceries, etc.

Such complexes can be used as hotels, shared time or hyperbaric hospitals for treatment of diverse illnesses that require pressures higher than the atmospheric one.

What is claimed is:

1. A bubble type submarine device comprising:

an air chamber body which includes a rigid internal frame structure, upper and lower hulls of molded material attached to said internal frame structure and an intermediate rigid cylindrical see-through section extending peripherally about said internal frame structure and secured in position relative to said internal structure;

an anchor block weighted to retain its position on an underwater floor bed;

leg supports extending from said air chamber body and attached to said anchor block;

an infrastructure support sub-system positioned at a coastal location;

a supply and extraction network which extends between the infrastructure support sub-system and the air chamber body and includes fresh air inlet tubing which feeds air to said air chamber body and an evacuation line which evacuates used air and heat generated in said air chamber body.

2. The bubble type submarine device of claim 1, wherein said supply and extraction unit includes an air recycle system which recycles air internally within said air chamber and which avoids recycling a portion of the air in said air chamber and directs it to said evacuation line.

3. The bubble type submarine device of claim 2, wherein said air chamber body includes kitchen and bathroom facilities and air exhausted from the kitchen and bathroom facilities is passed directly by said supply and extraction system directly to said evacuation line without recycling while air suctioned from another area in said air chamber body is recycled by said air recycle system.

4. The bubble type submarine device of claim 3 further comprising a valve in said air recycle system which is in communication with said evacuation line and varies a relative proportion of air returned for recycling and not returned for recycling from said another area.

5. The bubble type submarine device of claim 1 further comprising an air conditioner which has a heat exhaust line in communication with said evacuation line for avoiding build up of heat in an aquatic environment surrounding said air chamber body.

6. A bubble type submarine device comprising:

an air chamber body which includes a rigid internal frame structure, upper and lower molded hulls attached to said internal frame structure and an intermediate rigid cylindrical see-through section extending peripherally about said internal frame structure and secured in position relative to said internal structure;

an anchor block weighted to retain its position on an underwater floor bed;

leg supports extending from said air chamber body and attached to said anchor block;

and said cylindrical see-through section being comprised of a series of curved see-through segments and intermediate vertical support holders which have C-shaped reception cavities for receiving adjacent edges of a pair of adjacent see-through segments, and said see-through segments extending 360° about the cylindrical see-through section, and an upper and a lower strap member, with the upper strap member being of sufficient width to overlap both a peripheral edge of said upper hull and an upper edge of said see-through segments, and said lower strap member being of sufficient width to overlap both a peripheral edge of said lower hull and a lower edge of said see-through segments so as to compress said see-through segments relative to said C-shaped reception cavities so as to provide a rigid, self-sustaining force dissipating structure.

7. The bubble type submarine device of claim 6 wherein said upper and lower hulls are truncated conical hulls which have the same configuration based on being formed from identical molds.

8. The bubble type submarine device of claim 6 wherein said upper and lower hulls are fiberglass truncated conical hulls and each feature a series of identical inner mold hull sections extending about a central opening in an abutting relationship to form an internal central hole, and a series of identical outer mold hull sections that are attached to said inner mold hull along sections an interior end and attached to each other along common radially extending edges.

9. The bubble type submarine device of claim 8 wherein inner and outer mold hull sections are in an overlapping relationship and secured by fasteners.

10. The bubble type submarine device of claim 8 wherein said bubble type submarine has an inverted cup access chamber with an opening provided by the internal central hole defined by said lower hull.

11. The bubble type submarine device of claim 10 wherein said bubble type submarine has a see-through plate covering the internal central hole defined by said upper hull.

12. The bubble type submarine device of claim 6 wherein said see-through segments are formed of acrylic and said hulls of reinforced fiberglass.

13. A bubble type submarine device comprising:

an air chamber body which includes a rigid internal frame structure, upper and lower hulls of molded material attached to said internal frame structure and an intermediate rigid cylindrical see-through section extending peripherally about said internal frame structure and secured in position relative to said internal structure;

an anchor block weighted to retain its position on an underwater floor bed;

leg supports extending from said air chamber body and attached to said anchor block; and wherein said upper and lower hulls are fiberglass truncated conical hulls and each feature a series of identical inner mold hull sections extending about a central opening in an abutting relationship to form an internal central hole, and a series of identical outer mold hull sections that are attached to said inner mold hull along an interior end and attached to each other along common radially extending edges.

14. The bubble type submarine device of claim 13 wherein inner and outer mold hull sections are in an overlapping relationship and secured by fasteners.

15. The bubble type submarine device of claim 13 wherein said bubble type submarine has an inverted cup access chamber with an opening provided by the internal central hole defined by said lower hull.

16. The bubble type submarine device of claim 15 wherein said bubble type submarine has a see-through plate covering the internal central hole defined by said upper hull.

17. The bubble type submarine device of claim 13 wherein said see-through section is formed of a series of curved see-through segments extending about the entire cylindrical see-through section and formed of acrylic and said hull is formed of reinforced fiberglass.

18. The bubble type submarine device of claim 13 wherein said upper and lower hulls are formed of identical inner and outer hull sections which include handle members that are integrally molded in said upper and lower hull sections with the handles of said lower hull defining leg support attachments and the handles in said upper hull defining grasping means supports for use in manipulation of said air chamber body.

19. A bubble type submarine device comprising:

an air chamber body which includes a rigid internal frame structure, upper and lower hulls attached to said internal frame structure and an intermediate rigid cylindrical see-through section extending peripherally about said internal frame structure and secured in position relative to said internal structure;

an anchor block weighted to retain its position on an underwater floor bed;

leg supports extending from said air chamber body and attached to said anchor block;

an inverted cup access port in said lower hull;

an air supply system in communication with said air chamber body; and a sensor system for sensing a change in water level of water positioned in said inverted cup access port;

and said sensor being in communication with said air supply system to adjust an amount of air being fed to said air chamber body based on sensed information form said water level sensors.

20. The bubble type submarine device of claim 19 wherein said sensor system includes both a vibration sensor and a capacitive sensor.

21. The bubble type submarine device of claim 19 further comprising water thin sheet shock absorbers which include water receptacles in water communication with said access port to provide for reception and drainage of an upper sheet of water moving in said access port.

22. The bubble type submarine device of claim 21 further comprising a perforated plate to dampen rapid water sheet level fluctuations being sensed by said sensor system.

23. The bubble type submarine device of claim 19 further comprising a hermetic door to block said access port and seal off said air chamber body and means for adjusting pressure level in said sealed air chamber body so as to condition said air chamber body to be a hyperbaric chamber.

24. The bubble type submarine device of claim 19 further comprising polychromatic panels supported by said air chamber body, an ornamental bubble producer positioned so as to provide persons in said air chamber body a bubble display, a music system, and a fish feeder system and means for coordinating activity of said bubble producer, polychromatic panels, said fish feeder system and said music system.

25. A bubble type submarine device comprising:

an air chamber body which includes a rigid internal frame structure, upper and lower hulls attached to said internal frame structure and an intermediate rigid cylindrical see-through section extending peripherally about said internal frame structure and secured in position relative to said internal structure;

an anchor block weighted to retain its position on an underwater floor bed;

leg supports extending from said air chamber body and attached to said anchor block;

an inverted cup access port in said lower hull;

a sinking hoist system which includes horizontal and vertical movement systems including a downward draw section which pulls a buoyant supply module down to the horizontal movement system and a buoyant control vertical section that is positioned so as to receive the supply module from said horizontal movement system and control the rise of said supply module so as to have the supply module enter said inverted cup access port.

26. The bubble type submarine device of claim 25 further comprising a hoist positioned within said air chamber body for lifting said supply module out of said access port and into said air chamber body.

* * * * *